US009777720B2

(12) United States Patent
Gledhill, III et al.

(10) Patent No.: US 9,777,720 B2
(45) Date of Patent: Oct. 3, 2017

(54) HIGH PRESSURE, HIGH FLOW RATE TUBING ASSEMBLY AND ADAPTER FOR A POSITIVE DISPLACEMENT PUMP

(71) Applicant: Blue-White Industries, Ltd., Huntington Beach, CA (US)

(72) Inventors: Robert Gledhill, III, Huntington Beach, CA (US); John Nguyen, Fountain Valley, CA (US)

(73) Assignee: Blue-White Industries, Ltd., Huntington Beach, CA (US)

( * ) Notice: Subject to any disclaimer, the term of this patent is extended or adjusted under 35 U.S.C. 154(b) by 615 days.

(21) Appl. No.: 14/195,678

(22) Filed: Mar. 3, 2014

(65) Prior Publication Data

US 2014/0271293 A1 Sep. 18, 2014

Related U.S. Application Data

(60) Provisional application No. 61/786,040, filed on Mar. 14, 2013.

(51) Int. Cl.
*F04B 43/08* (2006.01)
*F04B 43/12* (2006.01)

(52) U.S. Cl.
CPC ..... *F04B 43/12* (2013.01); *F04B 43/08* (2013.01); *Y10T 29/49959* (2015.01)

(58) Field of Classification Search
CPC ..... F04B 43/0072; F04B 43/08; F04B 53/22; F04B 43/12; A61M 1/1008
USPC ..... 285/260
See application file for complete search history.

(56) References Cited

U.S. PATENT DOCUMENTS

| | | | | |
|---|---|---|---|---|
| 2,877,028 | A * | 3/1959 | Knight | F16L 39/02 285/124.4 |
| 2,916,055 | A | 12/1959 | Brumbach | |
| 3,366,071 | A * | 1/1968 | Hans Dutler | F04B 43/12 417/477.6 |
| 3,429,266 | A | 2/1969 | Jones | |
| 3,723,030 | A | 3/1973 | Gelfand | |
| 3,737,251 | A | 6/1973 | Berman et al. | |
| 3,740,173 | A | 6/1973 | Natelson | |
| 3,791,777 | A | 2/1974 | Papoff et al. | |
| 3,832,096 | A | 8/1974 | Gelfand | |
| 3,907,002 | A | 9/1975 | Gulich | |
| 4,289,459 | A | 9/1981 | Neeley et al. | |
| 4,473,173 | A | 9/1984 | DeGroff et al. | |

(Continued)

FOREIGN PATENT DOCUMENTS

| | | | | |
|---|---|---|---|---|
| GB | 2495937 | A * | 5/2013 | F04B 43/009 |

*Primary Examiner* — Nathan Zollinger
(74) *Attorney, Agent, or Firm* — Knobbe Martens Olson & Bear, LLP

(57) ABSTRACT

A tubing and adapter assembly is provided that can comprise a plurality of tubes or lumens that can be disposed within a head of a peristaltic pump. The tubing assembly can provide a flow rate or volume capacity that is generally equal to or greater than that achieved with a comparable prior art tube while operating at higher pressures than that possible using the prior art tube. Further, in accordance with some embodiments, the tubing assembly can achieve a longer working life than a comparable prior art tube, and the load on the pump motor can be reduced such that the pump life is increased and/or a larger pump motor is not required to achieve such advantageous results.

14 Claims, 24 Drawing Sheets

(56) References Cited

U.S. PATENT DOCUMENTS

| | | | | |
|---|---|---|---|---|
| 4,522,570 | A | 6/1985 | Schartz | |
| 4,604,038 | A | 8/1986 | Belew | |
| 4,648,812 | A | 3/1987 | Kobayashi et al. | |
| 4,722,559 | A * | 2/1988 | Bongartz | F16L 41/03 239/600 |
| 4,834,630 | A | 5/1989 | Godwin | |
| 4,878,622 | A | 11/1989 | Jamison et al. | |
| 4,982,903 | A | 1/1991 | Jamison et al. | |
| 5,025,270 | A | 6/1991 | Umezawa | |
| 5,037,274 | A | 8/1991 | Holmes et al. | |
| 5,257,917 | A | 11/1993 | Minarik et al. | |
| 5,335,943 | A * | 8/1994 | Duryea | F16L 33/00 285/12 |
| 5,443,451 | A | 8/1995 | Chapman et al. | |
| 5,460,493 | A | 10/1995 | Deniega et al. | |
| 5,772,624 | A * | 6/1998 | Utterberg | A61M 1/3621 128/898 |
| 5,846,061 | A | 12/1998 | Ledebuhr et al. | |
| 5,860,677 | A * | 1/1999 | Martins | F16L 37/088 285/26 |
| 5,870,805 | A | 2/1999 | Kandler et al. | |
| 5,988,801 | A | 11/1999 | Coiner | |
| 6,068,370 | A | 5/2000 | Miller et al. | |
| 7,118,203 | B2 | 10/2006 | Davis et al. | |
| 7,144,231 | B2 | 12/2006 | Davis | |
| 7,241,119 | B2 | 7/2007 | Harada | |
| 7,467,932 | B2 | 12/2008 | Schann et al. | |
| 7,513,757 | B2 | 4/2009 | Gibson et al. | |
| 7,591,639 | B2 | 9/2009 | Kent | |
| 8,393,879 | B2 | 3/2013 | Kent | |
| 2004/0022656 | A1 | 2/2004 | Anderson | |
| 2006/0002799 | A1 | 1/2006 | Schann et al. | |
| 2009/0053084 | A1 | 2/2009 | Klein | |
| 2011/0180172 | A1 | 7/2011 | Gledhill et al. | |
| 2014/0294633 | A1* | 10/2014 | Brokenshire | F04B 43/009 417/476 |

* cited by examiner

HIGH PRESSURE, HIGH FLOW RATE TUBING ASSEMBLY AND ADAPTER FOR A POSITIVE DISPLACEMENT PUMP

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims the benefit of U.S. Provisional Patent Application No. 61/786,040, entitled "HIGH PRESSURE, HIGH FLOW RATE TUBING ASSEMBLY AND ADAPTER FOR A POSITIVE DISPLACEMENT PUMP," filed on Mar. 14, 2013, which is hereby incorporated by reference in its entirety.

BACKGROUND

Field of the Invention

The present inventions relate to tubing assemblies, and more specifically to tubing assemblies for use with peristaltic pumps.

Description of the Related Art

A peristaltic roller pump typically has two or more rollers, but may have other configurations. The rollers are generally spaced circumferentially evenly apart and are mounted on a rotating carrier that moves the rollers in a circle. A length of flexible tubing may be placed between the rollers and a semi-circular wall. In medical and lab applications, the tubing can be a relatively soft and pliable rubber tubing. For relatively high-pressure industrial applications, however, the tubing can be exceedingly durable and rigid, albeit flexible under the high pressure of the rollers.

In use, the rollers rotate in a circular movement and compress the tubing against the wall, squeezing the fluid through the tubing ahead of the rollers. The rollers are configured to almost completely occlude the tubing, and operate essentially as a positive displacement pump, each passage of a roller through the semicircle pumps the entire volume of the fluid contained in the tubing segment between the rollers.

As a positive displacement pump, relatively high positive pressures can be generated at the pump outlet. Peristaltic roller pumps are typically driven by a constant speed motor that draws fluid at a substantially constant rate.

Typically, a large inventory of peristaltic pump tubing assembly adapters must be held to accommodate customer requirements. In most cases, the entire tubing assembly must be replaced if a customer changes the external fitting. Furthermore, traditional tubing assemblies for a peristaltic pump incorporate a metal clamp to hold the tubing to the adapter and prevent leakage. These assemblies are susceptible to metal corrosion due to the leakage of fumes into the pump head housing.

SUMMARY

The present inventions relate to pumps and tubing assemblies that are configured to pump fluids at high pressures and high flow rates. More particularly, the tubing assemblies can comprise multiple small diameter tubes that replace the traditional single large diameter hose in peristaltic pumps. In particular, embodiments disclosed herein can enable pumping against high pressures while providing a high flow rate, increased tube life, increased drive efficiency, lower replacement cost, lower energy consumption, cooler operating temperatures, and reduced operating and maintenance costs. Additionally, the tubing assemblies can comprise an interchangeable adapter system that may require less inventory cost and take up less inventory space. In some embodiments, the adapter system may include at least four mounts, at least four pump tubing grippers or locks, and at least four external system interface pieces. These pieces may be used interchangeably to fit a variety of tubing profiles, including single or dual tube or multiple lumen tubing, and customer requirements. In some embodiments, at least 64 different possible adapter system combinations may be made with an inventory of 12 different parts. All of these advantages are achieved while implementing designs that contrast with the traditional industry standard and knowledge.

In many facilities, typical water pressures can range from 60 to 85 PSI. Most municipalities prefer chemical pumps that can exceed system pressure by at least 20%. Some traditional peristaltic "tube" pumps (which use a single conduit having a diameter of less than 1 inch, referred to as a "tube") meet the requirements of some water treatment facilities that have small to medium chemical injection demands. However, system pressures and chemical flow rates often exceed the capabilities of existing peristaltic "tube" pumps. Consequently, operators must use larger peristaltic "hose" pumps (which, in contrast to peristaltic "tube" pumps, use a single conduit with a diameter of at least 1 inch or more, referred to as a "hose" because it is larger than a "tube"). Peristaltic hose pumps are considerably more expensive to operate (often three times more) because they use large, high-torque, high-horsepower AC drives.

Although peristaltic pumps have gained widespread popularity, the effectiveness of current peristaltic pumps is severely limited by the design of the tube or hose. The present Applicants spent considerable time and resources researching and redesigning large tubes and hoses for use in high pressure, high flow rate applications. The general rule in industry has always been that the larger diameter of the tube or hose, the higher the pump flow rate (or output). Further, high-pressure industrial peristaltic pumps typically require durable, stiff tubing in order to withstand high pressures. However, using a large diameter tube or hose at high pressure also requires a larger wall thickness in order to withstand the high pressure and avoid "ballooning." Tubing in a peristaltic pump tends to expand or balloon at the outlet side where system pressure is exerted, and the effects of the ballooning and relaxing of the tubing can build up over time. As the tube size increases in diameter (in order to increase flow rate), the ballooning effect becomes more prevalent. In order to overcome the ballooning problem, the wall thickness of the tubing must be increased, which in turn, causes more resistance to the pumping unit, adding more load to the pump drive unit. These challenges only increase as the required operating pressure is increased. Accordingly, the industry solution prior to the development of the present inventions was to provide a pump with a very powerful motor that can rotate the rollers over a single large diameter, large wall thickness, stiff tube or hose and deliver fluid at high pressures.

In contrast to prior art techniques and applications, some embodiments disclosed herein reflect the realization that instead of using a single large diameter, large wall thickness, stiff tube or hose in a peristaltic pump, high pressures and high flow rates can be achieved with a peristaltic tube pump that uses a system of two or more tubes in which each tube has a smaller diameter and a specific relationship between tube wall thickness and tube durometer. As a result, the pump motor can be much smaller and more efficient than the traditional counterpart peristaltic hose pump that uses a large, stiff tube with a large wall thickness. Moreover, some embodiments are capable of pumping at high pressures and high flow rates while also resulting in increased tube life, increased drive efficiency, lower replacement cost, lower energy consumption, cooler operating temperatures, and reduced operating and maintenance costs. Further, embodiments disclosed herein can deliver fluid at pressures and flow rates that well exceed industry demands. For example, some embodiments can deliver fluid at pressures at or well above 100 PSI while achieving the industry-required flow rates.

Accordingly, some embodiments reflect realizations that in contrast to prior art peristaltic pumps and systems that use a single larger, stiff tube, a peristaltic pump and system using multiple smaller tubes can handle higher pressures, have a longer tube life than a single larger tube, have better memory retention than a single larger tube, and be more energy efficient than a single larger tube. Thus, while the industry has sought to increase fluid output by increasing the size of the tube and increasing the RPM of the motor, some embodiments disclosed herein reflect a contrary view and achieve superior results by using multiple tubes with smaller diameters.

For example, some embodiments disclosed herein reflect the realization that due to the continual cycles of compression and relaxation produced by each pass of the rotating cam, larger diameter tubes (hoses) flatten out sooner, causing a lower flow rate after a short amount of time. Some embodiments disclosed herein also reflect the realization that the ballooning effect can be minimized by using smaller tubes, and that a pump can generally overcome this phenomenon without challenges. Furthermore, some embodiments reflect the realization that smaller tubes tend to retain original memory for an extended amount of time (much longer than a larger diameter tube), resulting in higher accuracy and longer tube life. Moreover, some embodiments reflect the realization that unlike traditional small diameter tubing (which has not been used in high-pressure applications and have a low pressure rating), embodiments can be provided in which a small diameter tube has a desired tube wall thickness and/or desired tube durometer, and/or a desired ratio of tube wall thickness to tube durometer.

Further, some embodiments disclosed herein reflect the realization that there are various potential hazards associated with running a peristaltic pump with large diameter tubing (hose). For example, as noted above, having a large wall thickness to achieve high pressures can cause additional load to the pump drive. Tube diameter expansion (ballooning) can occur on pressure side of pump, which can require additional pump drive load to overcome tube diameter expansion (ballooning) and may result in early tube rupture. In pumps having a glycerin-filled pump head (which is used to reduce friction and heat), tube rupture can cause glycerin to enter the fluid path and contaminate the system.

Additional embodiments disclosed herein illustrate a clamp-less adapter and tubing assembly for a peristaltic pump. Single or multi-lumen tubing assemblies may be manufactured with a variety of clamp-less adapters depending on customer requirements. The clamp-less adapter and tubing assembly takes up less space within the pump head housing than traditional clamped adapter and tube assemblies. In the case of multiple lumen tubing assemblies, the clamp-less style adapter assembly allows the tubes to be closer to each other, without interference from bulky metal clamps.

In some embodiments, a tubing and adapter assembly for a peristaltic pump includes an elongate body defining a longitudinal axis, a first end, and a second end, the elongate body having a plurality of lumens extending along the longitudinal axis, each lumen being surrounded by a tube wall, the plurality of lumens extending from the first end to the second end such that the first end is in fluid communication with the second end of the elongate body, a first tube mount having a first side wall defining a first tube interface surface, the first tube interface surface having at least one opening, a first end wall opposite the first tube interface surface, the first end wall and the first side wall defining a first recess, a second tube mount having a second side wall defining a second tube interface surface, the second tube interface surface having at least one opening, a second end wall opposite the second tube interface surface, the second end wall and the second side wall defining a second recess, a first external system interface having an annular surface defining a first flow passage, a first tubing interface portion, a first pump interface portion, and a first mounting interface portion, a second external system interface having an annular surface defining a second flow passage, a second tubing interface portion, a second pump interface portion, and a second mounting interface portion, wherein the first end of the elongate body is configured to be coupled with the first tube mount and the first external system interface and the second end of the elongate body is configured to be coupled with the second tube mount and the second external system interface such that a rotor of the peristaltic pump can operate against the tubing and adapter assembly for pumping fluid through the tubing and adapter assembly.

In other embodiments, an adapter assembly for a peristaltic pump includes a tube mount having an orifice for receiving a first end of a tube of the peristaltic pump, an external system interface having an orifice for receiving the first end of the tube of the peristaltic pump, and at least one pump tubing gripper configured to fit within the first end of the tube of the peristaltic pump, wherein the tube mount and the external system interface are coupled together.

In yet another embodiment, a method of manufacturing a clamp-less tubing assembly for a peristaltic pump includes the steps of inserting a first end of a tube through an orifice in an tube mount, pressing a pump tubing gripper into the first end of the tube, pressing the first end of the tube within an orifice of an external system interface, and coupling the tube mount to the external system interface.

BRIEF DESCRIPTION OF THE DRAWINGS

Various features of illustrative embodiments of the inventions are described below with reference to the drawings. The illustrated embodiments are intended to illustrate, but not to limit, the inventions. The drawings contain the following figures.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. In the description that follows, a peristaltic pump tubing assembly may include a tube or lumen. The terms "tube" and "lumen" are not synonymous. However, in the following description, the term "tube" is used generally to refer to peristaltic pump tubing which may also include one or more lumens.

As noted above, embodiments of the present inventions can overcome several prior art deficiencies and provide advantageous results. Some embodiments provide for a peristaltic pump that can operate at high pressures while maintaining a high flow rate. Some embodiments therefore allow the peristaltic pump to operate effectively at higher pressures and flow rates without requiring that the pump have a larger motor. Further, some embodiments can comprise a tubing assembly that can operate at high pressures and flow rates without requiring a larger wall thickness. Furthermore, some embodiments can comprise a tubing assembly that utilizes multiple lumens that are acted upon by one or more rollers to achieve a high flow rate at high pumping pressures. Some embodiments of tubing assemblies that utilize multiple lumens are discussed in U.S. patent application Ser. No. 13/011,822, entitled "HIGH PRESSURE, HIGH FLOW RATE TUBING ASSEMBLY FOR A POSITIVE DISPLACEMENT PUMP," filed Jan. 21, 2011, which is hereby incorporated by reference in its entirety.

Figure 1:
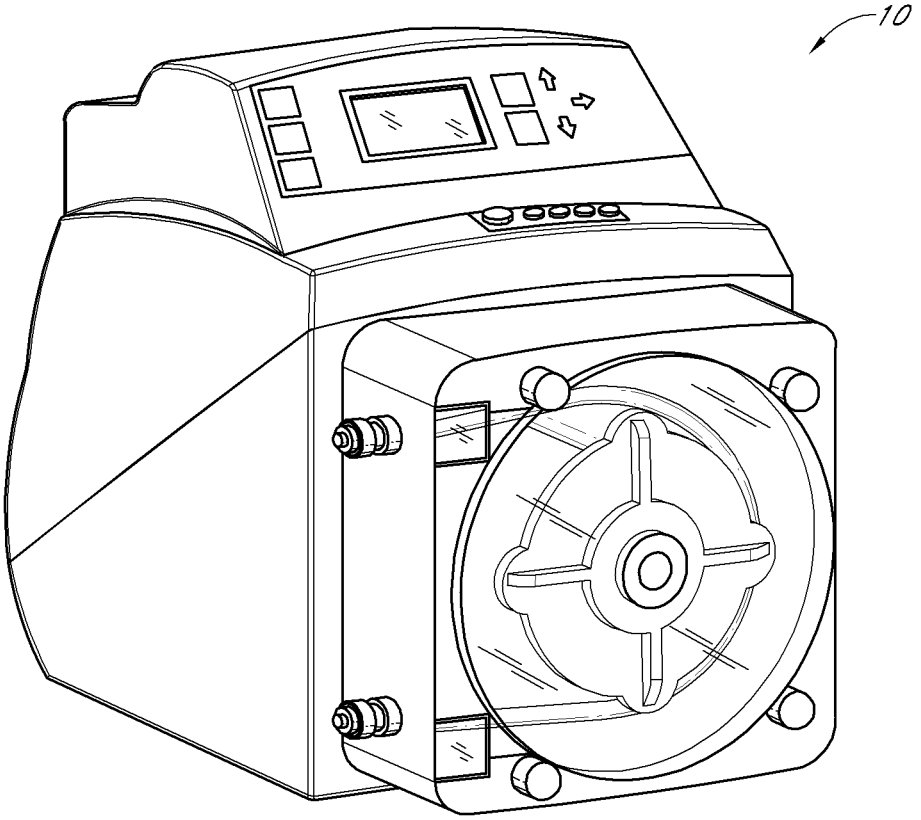
FIG. 1 (PRIOR ART)
FIG. 1 is a perspective view of a prior art peristaltic pump.
Figure 2:
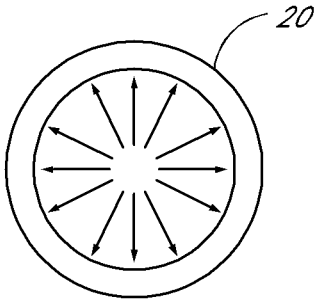
FIG. 2 (PRIOR ART)
FIG. 2 is a cross-sectional view of tubing of the prior art peristaltic pump shown in FIG. 1.

FIG. 1 illustrates a prior art peristaltic pump 10 that uses a single tube 20, which is shown in cross-section in FIG. 2. As discussed above, one of the problems associated with a single tube arrangement in a peristaltic pump is that the pressure and flow rate are limited. For example, if the pressure is to be increased, the wall thickness of the tubing must also be increased, which creates additional stress on the pump drive. Further, if the flow rate is to be increased, the inner diameter of the tubing and/or the roller RPM must also be increased, which can result in shorter tubing life and higher stress on the pump drive. Therefore, in order to increase both the pressure and flow rate, the tubing life is generally decreased while tubing failure and pump stress is increased. Therefore, at least one of the embodiments disclosed herein reflects that an increased pressure and/or flow rate has only been possible by sacrificing tubing life or increasing the size of the motor of the peristaltic pump.

Figure 3:
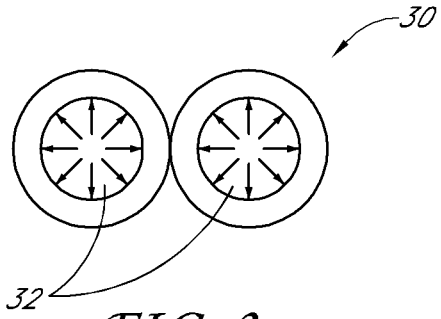
FIG. 3 is a cross-sectional view of a tubing assembly, according to an embodiment disclosed herein.
Figure 4:
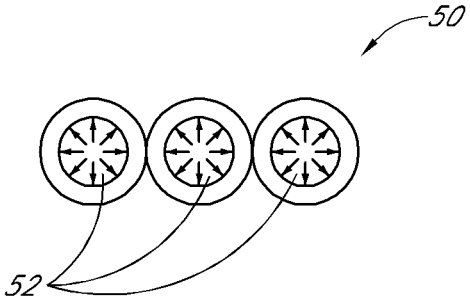
FIG. 4 is a cross-sectional view of a tubing assembly, according to another embodiment disclosed herein.
Figure 22A:
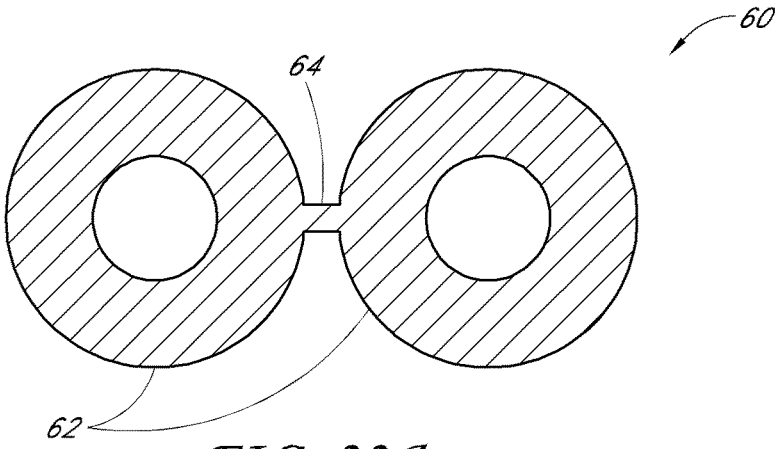
FIGS. 22A-C illustrate cross-sectional view of various tubing assemblies, according to embodiments disclosed herein.
Figure 22B:
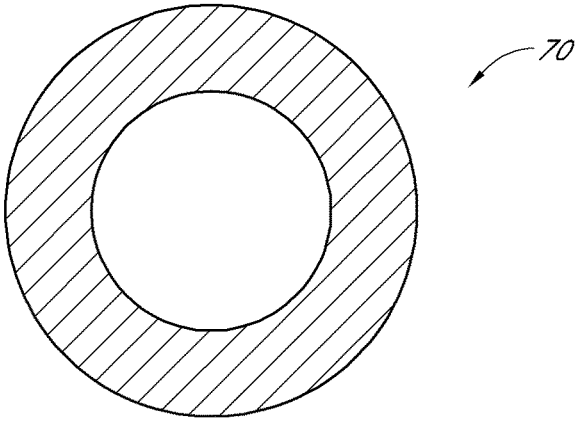
FIG. 22B (PRIOR ART)
Figure 22C:
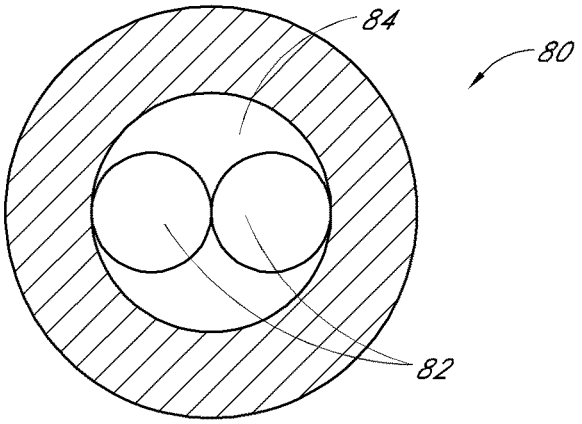

FIGS. 3-4 illustrate embodiments of a tubing assembly fabricated in accordance with principles of the inventions disclosed herein. For example, FIG. 3 illustrates a tubing assembly 30 having a pair of lumens 32. FIG. 4 similarly illustrates a tubing assembly 50 having a plurality of lumens 52. Further, the tubing assembly can be configured to comprise four or more lumens. Some additional embodiments of a tubing assembly fabricated in accordance with principles of the inventions disclosed herein are shown in FIGS. 22A-C. For example, FIG. 22A illustrates a tubing assembly 60 having a pair of lumens 62 separated by an attachment portion 64. FIG. 22B illustrates a tubing assembly 70 having a single lumen 72 according to the prior art. FIG. 22C illustrates a tubing assembly 80 having a plurality of lumens 82 fully enclosed within a single lumen 84. As shown in FIG. 22C, the inner lumens may be tangential with one another and with the inner diameter of the enclosing lumen.

The lumens of tubing assembly can extend along a longitudinal direction of the tubing assembly. In this regard, the tubing assembly can comprise a first end and a second end. The lumens of the tube assembly can extend intermediate the first end and the second end such that the first end and the second end are in fluid communication with each other.

Further, each of the lumens can be surrounded by a wall structure. In some embodiments, the lumens can be surrounded by a wall structure having a generally constant thickness. In other embodiments, the lumens can be surrounded by a wall structure having a variable thickness. However, in some embodiments, the wall thickness and inner diameter of the tube can be generally constant along the length of the tube. The multiple lumens of the tubing assembly shown in FIG. 22A may be partially or entirely separated by tearing the two lumens apart starting at one of the first or second ends of the tubing assembly. Separation of the multiple lumen openings at either one or both of the first and second ends allows the tubing assembly to be installed with an tube mount having a plurality of openings corresponding to the number of lumens of the tubing assembly, as will be discussed in greater detail below.

Some embodiments reflect the realization that high pressures and high flow rates can be achieved in a peristaltic tube pump by using a system of one, two, or more small tubes. In some embodiments, multiple tubes can be used to replace a single tube in order to allow for pumping higher volumes at higher pressures. The tubes in such an arrangement can each be uniquely configured to provide desired strength and durometer characteristics. Through substantial testing and analysis, the Applicants have discovered excellent pressure, tube life, and flow characteristics using the measurements, ranges, and tubing characteristics disclosed herein.

For example, in some embodiments, the inside diameter of a tube can be within a range of at least about 1/16" (1.59 mm) and/or less than or equal to about 3" (76.2 mm). The inside diameter of a tube in some embodiments can be at least about 1/8" (3.18 mm) and/or less than or equal to about 1.5" (25.4 mm). Further, in some embodiments, the inside diameter of a tube can be at least about 1/2" (12.7 mm) and/or less than or equal to about 1" (25.4 mm). For some larger capacity applications, the inside diameter of a tube can be about 3/4" (19.1 mm). For some smaller capacity applications, the inside diameter of a tube can be about 3/8" (9.5 mm). In some embodiments, such as the embodiment illustrated in FIG. 22C, the inner diameter of a pair of lumens enclosed within a single outer lumen may be at least about 1/8" (3.18 mm) and/or less than or equal to about 1.5" (25.4 mm) and the inner diameter of the single outer lumen may be at least about 1/4" (6.36 mm) and/or less than or equal to about 3" (50.8 mm). Two or more tubes can be used together in a tubing application. Thus, a tubing assembly can be provided in which two or more tubes having an inside diameter within the ranges or at the dimensions listed above.

Further, embodiments are provided in which the tube wall thickness is within a range of at least about 1/32" (0.80 mm) and/or less than or equal to about 1" (25.4 mm). In some embodiments, the tube wall thickness can be within a range of at least about 1/16" (1.59 mm) and/or less than or equal to about 1/2" (12.7 mm). In some embodiments, the tube wall thickness can be within a range of at least about 1/8" (3.18 mm) and/or less than or equal to about 5/16" (7.94 mm). In some larger applications, the tube wall thickness can be about 9/32" (7.14 mm). In smaller applications, the tube wall thickness can be about 3/16" (4.76 mm).

Additionally, some embodiments reflect the realization that high pressures and high flow rates can be achieved in a peristaltic tube pump by using a system of one, two, or more tubes in which each tube has a specific relationship between the inner diameter, tube wall thickness, and/or the durometer of the tube. In embodiments using more than one tube, the tubes can be identical. However, the tubes can have different dimensions; for example, the tubes can vary in inner diameter, tube wall thickness, and/or tube durometer. Additionally, as the tube wall thickness increases, the horsepower of the motor must also increase.

In some embodiments, the tube can be configured to have a ratio of tube wall thickness to tubing inner diameter of at least about 20% (0.2:1) and/or less than or equal to about 125% (1.25:1). In some embodiments, the ratio of the tube wall thickness to the inside diameter of a tube can be at least about 20% (0.2:1) and/or less than or equal to about 60% (0.6:1). In some embodiments, the tube can be configured to have a ratio of tube wall thickness to tubing inner diameter of at least about 25% (0.25:1) and/or less than or equal to about 50% (0.50:1). In some embodiments, the ratio of the tube wall thickness to the inside diameter of a tube can be at least about 25% (0.25:1) and/or less than or equal to about 45% (0.45:1). Further, in some embodiments, the ratio of the tube wall thickness to the inside diameter of a tube can be at least about 27% (0.27:1) and/or less than or equal to about 43% (0.43:1). It has been found in some embodiments that excellent pumping qualities and results are achieved when the ratio of tube wall thickness to the inside diameter of a tube is about 28% (0.28:1).

For example, in some embodiments, the inside diameter of a tube can be at least about 1/16" (1.59 mm) and/or less than or equal to about 2" (50.8 mm), and the tube wall thickness of the tube can be at least about 1/32" (0.80 mm) and/or less than or equal to about 5/8" (15.9 mm). Further, in some embodiments, the inside diameter of a tube can be at least about 3/8" (9.53 mm) and/or less than or equal to about 1.5" (38.1 mm), and the tube wall thickness of the tube can be at least about 1/8" (3.175 mm) and/or less than or equal to about 1/2" (12.7 mm). In some larger applications, the inside diameter of a tube can be about 1" (25.4 mm), and the tube wall thickness of the tube can be about 5/16" (7.94 mm). In other applications, the inside diameter of a tube can be about 3/4" (19.1 mm), and the tube wall thickness of the tube can be about 7/32" (5.56 mm). One, two, three, four, or more tubes having such dimensions can be used in a peristaltic tube pump.

In some embodiments, the durometer of a tube can be within the Shore A hardness, within a range of at least about 70 and/or less than or equal to about 90. In some embodiments, the durometer of a tube can be at least about 75 and/or less than or equal to about 90. Further, the durometer of a tube can be at least about 80 and/or less than or equal to about 90. The durometer of a tube can be at least about 83 and/or less than or equal to about 90. Furthermore, the durometer of a tube can be at least about 85 and/or less than or equal to about 89. Durometer values within the above-noted ranges can be implemented for a tube having an inner diameter and/or thickness within any of the above-noted ranges for those parameters. For example, a tube can have inside diameter of at least about 1/16" (1.59 mm) and/or less than or equal to about 1/2" (12.7 mm), a tube wall thickness of at least about 3/32" (2.38 mm) and/or less than or equal to about 3/16" (4.76 mm), and a durometer of at least about 75 and/or less than or equal to about 90.

In their studies, Applicants have found excellent test results when comparing multi-tube tubing assemblies to single tube tubing assemblies having approximately equivalent flow rates. In particular, when compared to similar single tube tubing assemblies, multi-tube tubing assemblies provide a much higher tube life before tube failure and experience minimal variance or drop-off in flow rate during the life of the tube.

For example, Applicants have discovered that a dual tubing assembly having tubes with a 3/8" inside diameter, a durometer of 80, and a tube wall thickness of between about 0.095" to about 0.10", tested with water at 30 PSI and 125 RPM, resulted in tube life of 1072 hours until failure. At these dimensions, the ratios of the wall thickness to the inside diameter is about 26%. Further, at 30 PSI and 125 RPM, the dual tubing assembly had a flow rate drop of only 1.25% over the life of the tube (indicative of superior tubing memory characteristics). In particular, the flow rate at start-up was about 7580 ml/min and the flow rate about 24 hours prior to tube failure was 7485 ml/min.

In contrast, a single 1/2" inside diameter tube and a tube wall thickness of about 0.125", was tested with water at 30

PSI and 125 RPM and resulted in a tube life of only 344 hours until failure. Further, at 30 PSI and 125 RPM, the single tube had a flow rate drop of 21.4% over the life of the tube (indicative of poor tube memory characteristics). In particular, the flow rate at start-up was about 6900 ml/min and the flow rate about 24 hours prior to tube failure was about 5420 ml/min.

In further contrast, a single ¾" inside diameter tube and a tube wall thickness of about 0.125", was tested with water at 30 PSI and 125 RPM and resulted in a tube life of only 270 hours until failure. Further, at 30 PSI and 125 RPM, the single tube had a flow rate drop of 19.1% over the life of the tube (indicative of poor tube memory characteristics). In particular, the flow rate at start-up was about 9043 ml/min and the flow rate about 24 hours prior to tube failure was about 7316 ml/min.

Accordingly, based on these results, embodiments of a multi-tube tubing assembly can provide far superior tube life and maintain higher flow rates with minimal flow rate reduction over the life of the tubing assembly when compared with a single, larger inside diameter tube that provides approximately the same flow rate as the multi-tube tubing assembly. In this regard, a tubing assembly of two ⅜" inside diameter tubes would provide higher tube life and lower variance than a comparable 9/16" inside diameter single tube assembly. Further, other benefits are achieved including decreased loads that enable the use of a smaller pump, easier handling, and increased longevity and efficiency in an operation. Applicants also note that in the field of high pressure, high flow rate pumping, the loss of viable tube life and decrease in flow rate are longstanding problems with single tube designs and have been unresolved until the introduction of embodiments disclosed herein.

In some embodiments, Applicants have also found that the use of a multi-tube tubing assembly achieves higher flow rates than single tube assemblies due to an increased tubing length. For example, a ⅜" inside diameter dual tube assembly can have a 18 ⅛" length as compared to a ½" inside diameter or ¾" diameter single tube assembly that has a 17 ¾" length. The 18 ⅛" length of tubing advantageously provides improved flow rates as opposed to the 17 ¾" length. Accordingly, some multi-tube embodiments can provide additional advantages over single tube assemblies.

A desirable ratio of tube wall thickness to the tube durometer can beneficially enable the tubing to have an optimal size and performance. Some embodiments can be configured such that the wall thickness of the tube can be inversely related the durometer of the tube. The thickness and durometer can be modified to provide various benefits, such as enabling the use of a pump motor that is much smaller and more efficient than the traditional counterpart pump required for a peristaltic hose pump. Moreover, some embodiments are capable of pumping at high pressures (exceeding 100 to 125 PSI) and high flow rates while also resulting in increased tube life, increased drive efficiency, lower replacement cost, lower energy consumption, cooler operating temperatures, reduced operating and maintenance costs, and reduced shipping costs.

The lumens of the tubing assembly can also be coupled or joined within the tubing assembly using a variety of manufacturing techniques. In some embodiments, the tubing assembly can be extruded and therefore comprise a monolithic part. Some embodiments can comprise two or more separate parts. For example, some embodiments can be configured such that the tubing assembly 30 comprises one or more tubes that are fused together at a joint. Such an embodiment is shown in FIGS. 3 and 4. Additionally, some embodiments can be configured such that the tubing assembly comprises a plurality of tubes that are coupled to each other via an intermediate coupling or attachment portion.

Moreover, some embodiments can be configured to comprise a plurality of individual tubes. For example, a plurality of individual tubes can be disposed side-by-side within the pump head or cavity of the peristaltic pump.

In addition, when the tubing assemblies of 30, 50 are compared to the tubing assembly 20, the volume capacity of the tubing assemblies 30, 50 can be the same as the tubing assembly 20. For example, the flow area or cross-sectional area as defined by the inner diameter of the lumens of the tubing assemblies 30, 50 can be equal to the flow area or cross-sectional area as defined by the inner diameter of the lumen of the tubing assembly 20. Other advantages may also be present which enable the volume capacity of the tubing assemblies to be equivalent as well.

For example, the rotations per minute (RPM) or drive speed of the roller assembly may be higher when the tubing assemblies 30, 50 are used because of the lower rolling resistance and loading on the pump motor. Thus, it is possible to use tubing assemblies having a flow area that is smaller than a comparable prior art tube while maintaining a common volume capacity or flow rate. Indeed, the volume capacity or flow rate of a given embodiment can be greater than the volume capacity or flow rate of a prior art tube that has a larger flow area than that of the given embodiment. An additional benefit of embodiments disclosed herein is that the volume capacity or flow rate of an embodiment can be equal to the volume capacity or flow rate of a prior art tube while reducing the load on the pump motor. In this manner, embodiments disclosed herein can advantageously increase tubing life and pump motor life.

Figure 5:
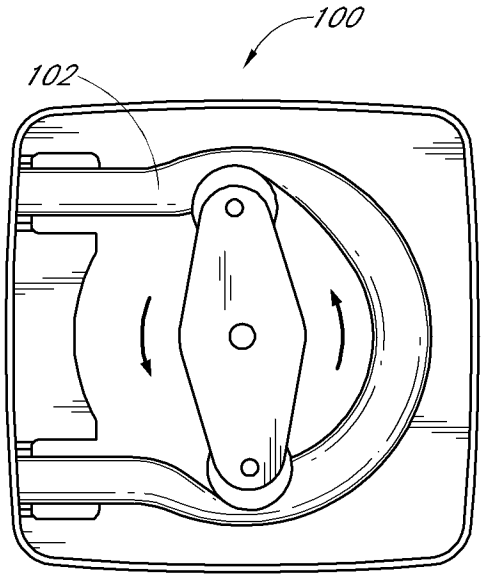
FIG. 5 (PRIOR ART)
FIG. 5 illustrates the interaction of rollers in a peristaltic pump head when operating against prior art tubing.

FIG. 5 illustrates a prior art peristaltic pump 100 in which the tubing 102 is a larger size in order to provide for a higher flow rate. The rollers of the peristaltic pump operate against the tubing 102 and create a large depression in the tubing 102 as the tubing 102 is compressed against the interior wall of the pump head or pump cavity. As a result, the rollers encounter greater resistance and overall, the peristaltic pump is subjected to high loads with the tubing 102 being compressed and deformed against the roller.

Additionally, as the pump 100 operates at high pressures, the tubing 102 can be subject to significant internal pressures which can result in ballooning and/or rupture of the tubing 102. This unfortunate result is due at least in part to the wall thickness of the tubing 102 and the inner diameter of the tubing 102. Therefore, if the wall thickness of the tubing 102 is not increased, the tubing 102 may be subject to failure at high pressures. However, if the wall thickness of the tubing 102 is increased, the rollers of the pump will encounter a greater resistance in compressing the tubing 102 and therefore result in an increased load for the peristaltic pump 100.

Figure 6:
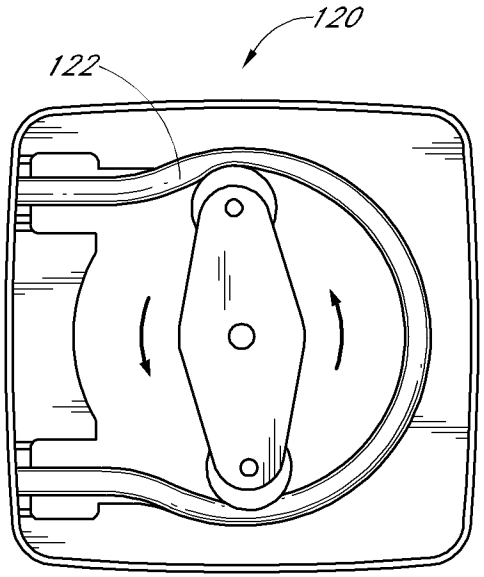
FIG. 6 illustrates the interaction of rollers in a peristaltic pump head when operating against a tubing assembly according to an embodiment disclosed herein.

FIG. 6 illustrates a peristaltic pump 120 and tubing 122 formed in accordance with an embodiment disclosed herein. Although shown in side view, the tubing 122 comprises a plurality of lumens, similar to one of the embodiments illustrated above in FIGS. 3-4. As will be discussed further herein, the tubing 122 can also be representative of another embodiment, such as one of the embodiments illustrated in FIGS. 7-14.

As shown, the tubing 122 is comparatively much smaller in outer diameter than the tubing 102 illustrated in FIG. 5. Thus, the tubing 122 can be configured to provide an appropriate wall thickness to inner diameter ratio while having a compression radius that is much smaller than the compression radius of the tubing 102. A "compression radius" can be considered as the amount of radial deflection of the tubing as measured relative to the axis of rotation of the roller assembly of the pump. The compression radius of the tubing 102 is illustrated as being much less than the compression radius of the tubing 122. Such a factor is relevant in computing rolling resistance of the roller assembly of the pump, which relates to the load on the pump in order to cause rotation of the roller assembly. Accordingly, when compared with the pump 100 and the tubing 102, the rollers of the peristaltic pump 120 will generally undergo a lower degree of rolling resistance while compressing against the tubing 122, thus decreasing the load on the pump 120.

Figure 7:
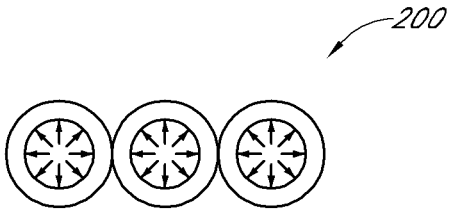
FIGS. 7-14 illustrate cross-sectional views of various tubing assemblies, according to embodiments disclosed herein.

FIGS. 7-14 illustrate various embodiments of tubing assemblies formed in accordance with the principles and teachings herein. FIG. 7 illustrates a tubing assembly 200 similar to the tubing assembly shown in FIG. 3.

Figure 8:
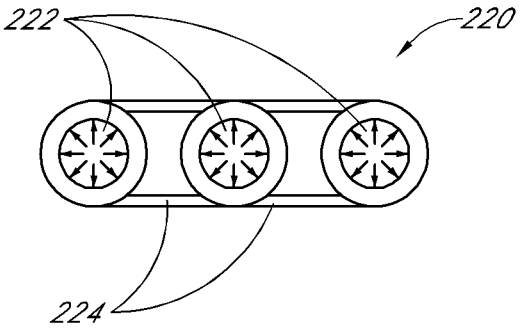

FIG. 8 illustrates a tubing assembly 220 having a plurality of lumens 222 through which fluid can pass. The tubing assembly 220 of FIG. 8 can be configured such that the lumens 222 are spaced apart from each other by a void, hollow portion, or lumen. The lumens 222 can each be disposed in a tube that is separated from an adjacent to by the void or lumen. The tubes can be interconnected via one or more couplings or attachment portions 224. The couplings or attachment portions 224 can extend along the entire length of the tubing assembly 220. Alternatively, the couplings or attachment portions 224 can have a longitudinal length that is less than the longitudinal length of the tubing assembly 220. In such an embodiment, the couplings or attachment portions 224 can be disposed at a plurality of longitudinal positions along the length of the tubing assembly 220.

Further, the couplings or attachment portions 224 can be separate from and later attached to the tubes or formed monolithically with the tubes in an extrusion process. For example, the middle tube of the tubing assembly 220 can be formed monolithically with the couplings or attachment portions 224 such that the overall thickness or width of the tubing assembly 220 as measured at the middle tube thereof does not exceed the outer diameter of the middle tube thereof.

Furthermore, the couplings or attachment portions 224 can extend generally tangentially relative to the tubes of the tubing assembly so as to connect upper and lower points of the tubes to each other. The dimension and the coupling of the couplings or attachment portions 224 can therefore be accomplished along the entire length of the assembly, along only a portion of the length of the tubing assembly, at one or more locations or positions along the tubing assembly, and/or integrated with one or more tubes of the tubing assembly. In this manner, the tubing assembly can therefore be configured generally in the shape of a ribbon of tubes.

Figure 9:
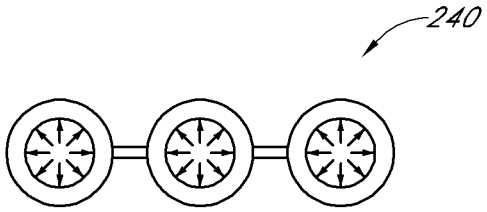

FIG. 9 illustrates a tubing assembly 240 having a plurality of tubes defining interior lumens. The tubes of the tubing assembly 240 can be coupled to each other by one or more couplings or attachment portions that extend intermediate the tubes. In particular, FIG. 9 illustrates that a single length of a coupling or attachment portion extends between a given pair of tubes. As noted above, the longitudinal dimension or length of the couplings or attachment portions can be equal to the longitudinal length of the tubing assembly or less than a longitudinal length of the tubing assembly. Further, in some embodiments, the couplings or attachment portions can be disposed at one or more positions along the length of the tubing assembly. FIG. 22C illustrates a similar tubing assembly 60 as that shown in FIG. 9. The tubes of the tubing assembly 60 can be coupled to each other by one or more couplings or attachment portions that extend intermediate the tubes. As discussed above, the coupling or attachment portion 64 that extends intermediate the tubes 62 of the tubing assembly 60 may be cut or severed along the longitudinal or length dimension of the attachment portion such that the tubes 62 may be separated lengthwise from each other.

Figure 10:
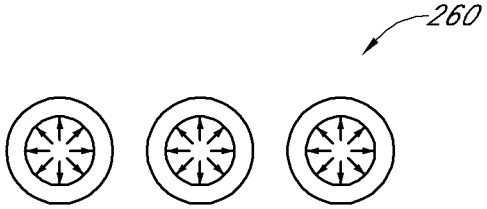
Figure 11:
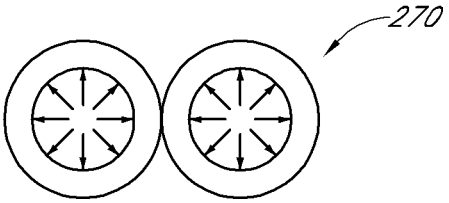
Figure 12:
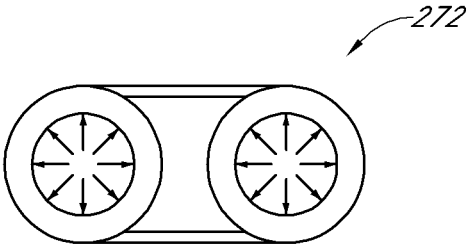
Figure 13:
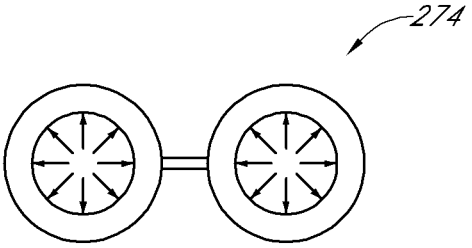
Figure 14:
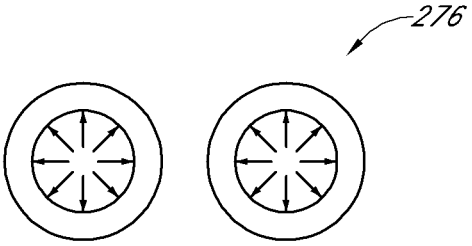

FIG. 10 illustrates a tubing assembly 260 comprising a plurality of tubes that each defines an interior lumen. In this embodiment, the tubes can be generally unconstrained or detached from each other. In particular, the tubing assembly can be devoid of any interconnections between the tubes. As such, the tubes can flex during compression without being physically constrained relative to each other.

As discussed above, each of the tubes of a tubing assembly can define a wall thickness. The wall thickness of a given tube can be different from the wall thickness of another tube of the tubing assembly. For example, one or more of the tubes of a tubing assembly can have an inner diameter, outer diameter, and/or wall thickness that is different from another of the tubes of the tubing assembly.

In addition, in embodiments that utilize a coupling or attachment portion, the ratio of the thicknesses of the coupling or attachment portion relative to the wall of the tube can be at least about 1:1 and/or less than or equal to about 1:3. In some embodiments, the ratio of the thicknesses can be about 1:2.

FIGS. 11-14 illustrate two-tube embodiments corresponding to the three-tube embodiments illustrated and discussed above in FIGS. 7-10. As shown, the embodiments in FIGS. 11-14 include a pair of tubes or lumens instead of three tubes or lumens. Nevertheless, the principles and features discussed above with respect to the tubing assemblies 200, 220, 240, 260 shown in FIGS. 7-10, as well as the tubing assemblies 60, 70, and 80 of FIGS. 22A-C, can also be applied to the embodiments of the tubing assemblies 270, 272, 274, and 276 shown in FIGS. 11-14. Accordingly, the above discussion is incorporated herein with respect to FIGS. 11-14, but will not be repeated. In accordance with the embodiments disclosed herein, a high flow rate can be obtained at high pressure.

Figure 15:
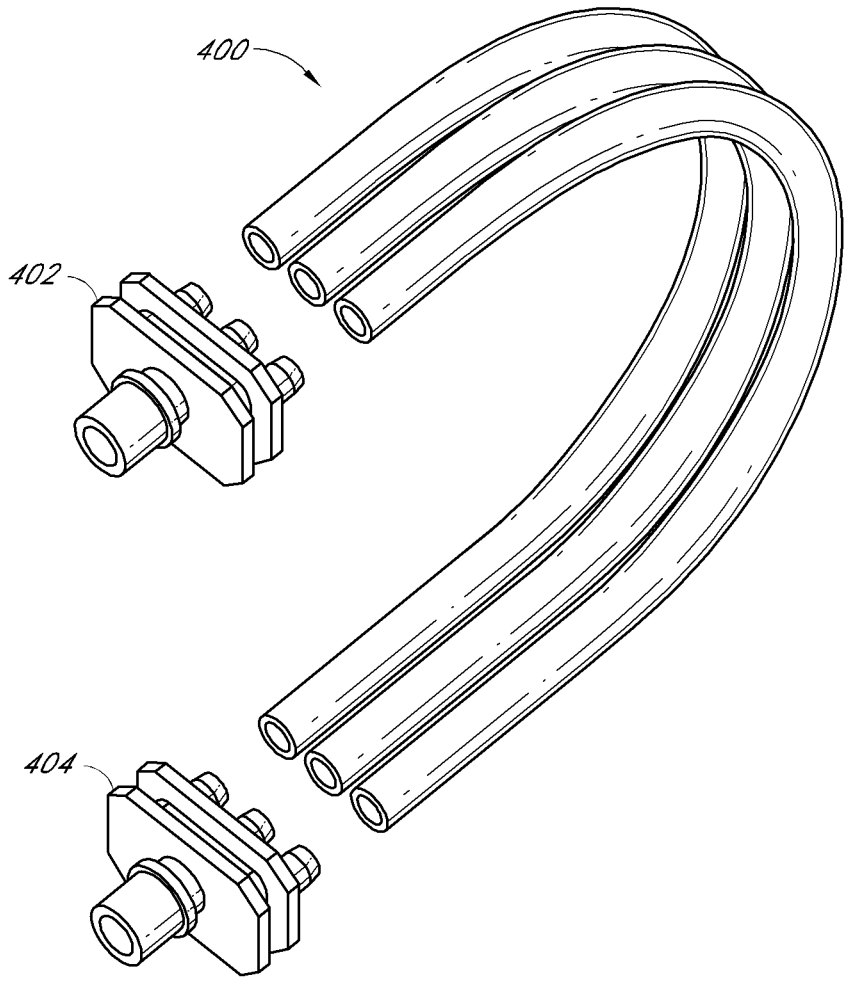
FIG. 15 illustrates a tubing assembly and connectors for a peristaltic pump, according to an embodiment.

FIG. 15 illustrates a tubing assembly 400 that can be coupled with first and second tubing connectors 402, 404. Once the tubing assembly 400 is coupled to the first and second tubing connectors 402, 404, the tubing assembly 400 can be installed into a peristaltic pump. Although the tubing assembly 400 is illustrated as comprising three lumens or tubes, the assembly 400 can comprise two, four, or more lumens or tubes. Further, the assembly 400 illustrates the use of a single inlet and a single outlet. Thus, in some embodiments, a single inlet and single fluid source can be split into a plurality of lumens or tubes in a tubing assembly, pumped through the pump head, and then rejoined through a single outlet. However, as shown in subsequent FIGS. 16-17 below, multiple pump sources can be used to feed lumens or tubes of a tubing assembly.

Figure 16:
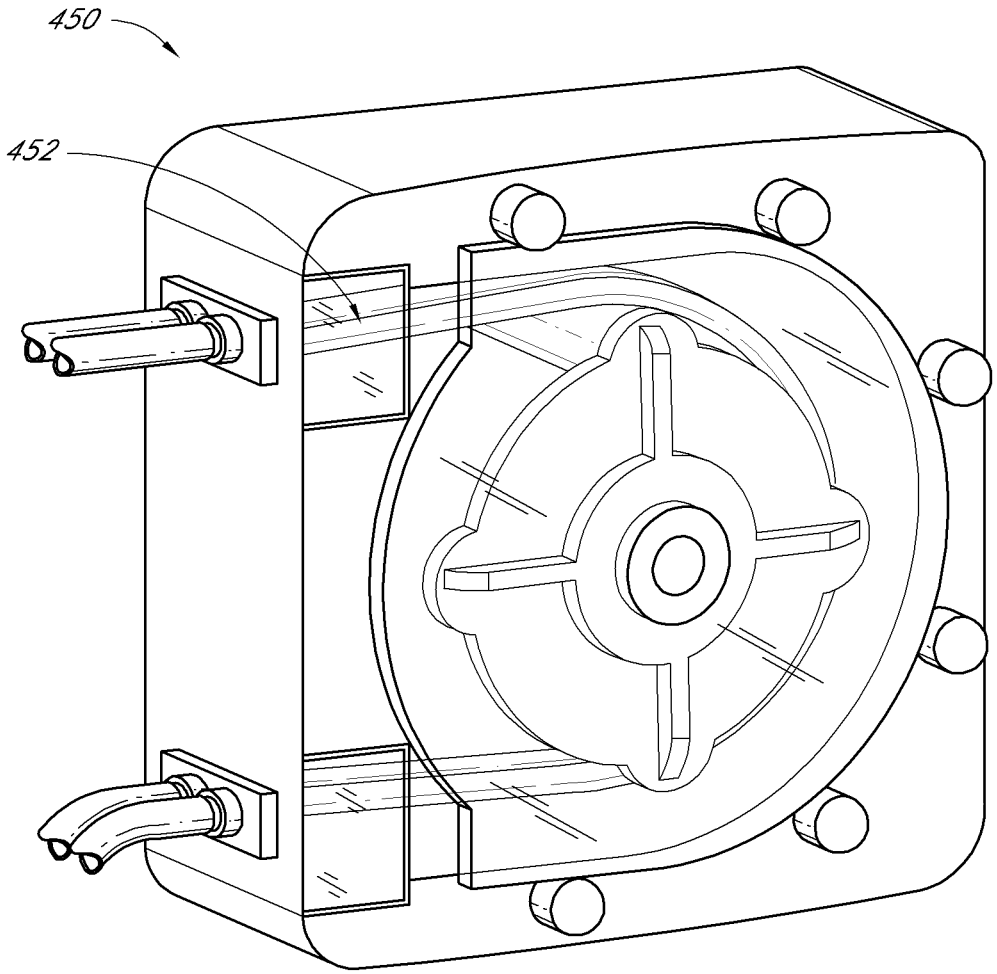
FIG. 16 illustrates a peristaltic pump having a tubing assembly formed in accordance with the principles disclosed herein, according to an embodiment.
Figure 17:
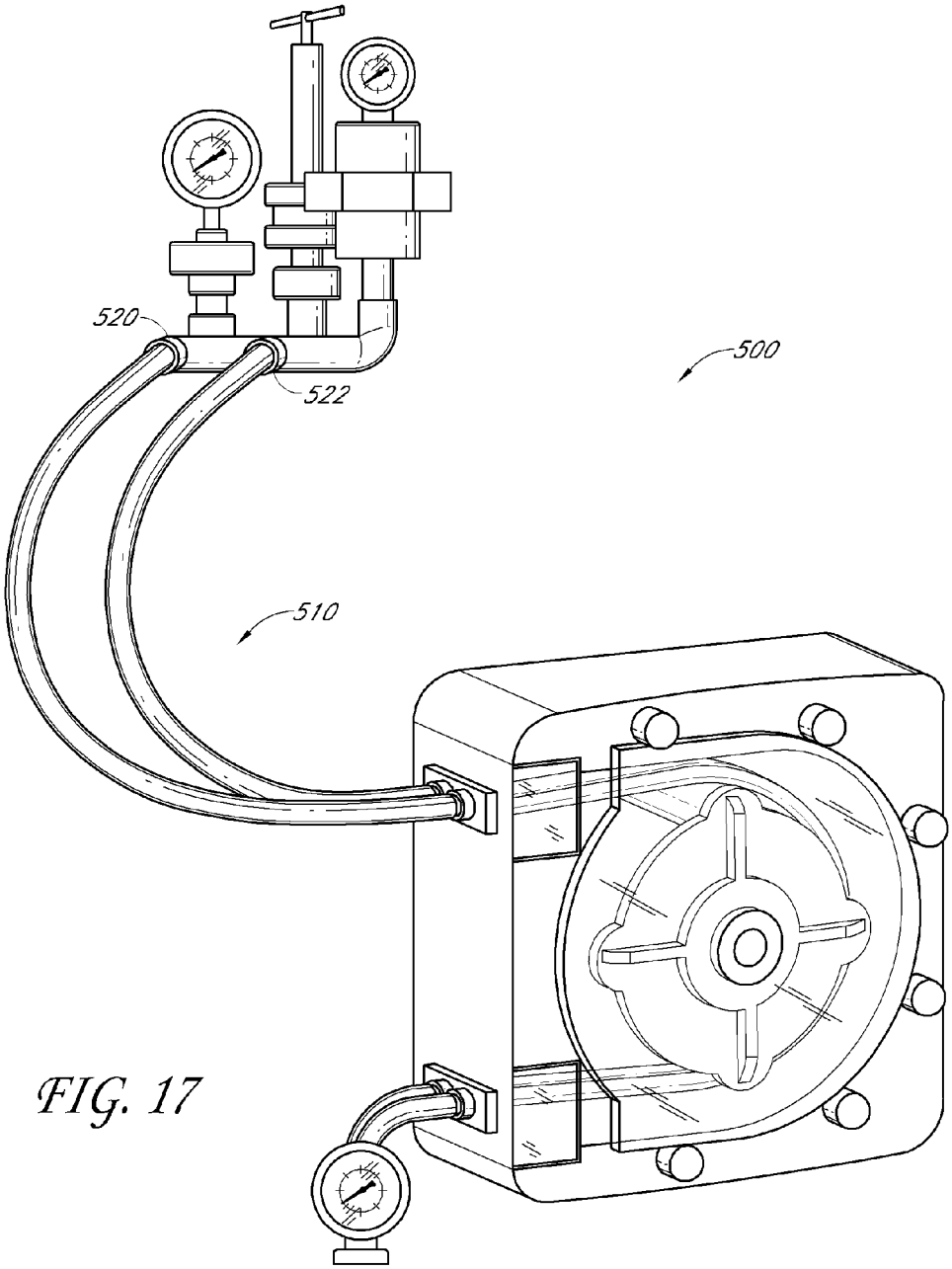
FIG. 17 illustrates a peristaltic pump and tubing assembly in accordance with an embodiment.

FIGS. 16-17 illustrate peristaltic pumps that utilize a tubing assembly according to an embodiment disclosed herein. As shown in FIG. 16, the peristaltic pump 450 can be retrofitted with a tubing assembly 452 of one of the embodiments disclosed herein without modifying the pump head or rollers. Thus, existing peristaltic pumps can beneficially use embodiments of the tubing assembly disclosed herein. However, the peristaltic pump can also be modified such that the pump cavity is deeper or wider in order to receive an embodiment of the tubing assembly's disclosed herein.

The tubing assembly of embodiments disclosed herein can comprise a plurality of lumens or tubes that are operatively connected to one or more fluid inlets and one or more fluid outlets. In this regard, as shown in FIG. 15, a plurality of tubes or lumens can be operatively connected to a single inlet and a single outlet. However, in some embodiments, as illustrated in FIG. 17, a peristaltic pump 500 can operate on a tubing assembly 510 in which an inlet of one or more of the tubes or lumens of the tubing assembly 510 is coupled to a first fluid source 520 and an inlet of another one or more tubes or lumens of the tubing assembly 510 is coupled to a second fluid source 522. Thus, the tubing assembly 510 can operate with one or more working fluids passing through one or more tubes or lumens thereof. The multiple fluid sources can be joined to a single outlet; however, multiple outlets can also be used that correspond to the multiple inlets and the fluids can be maintained separate.

Figure 18:
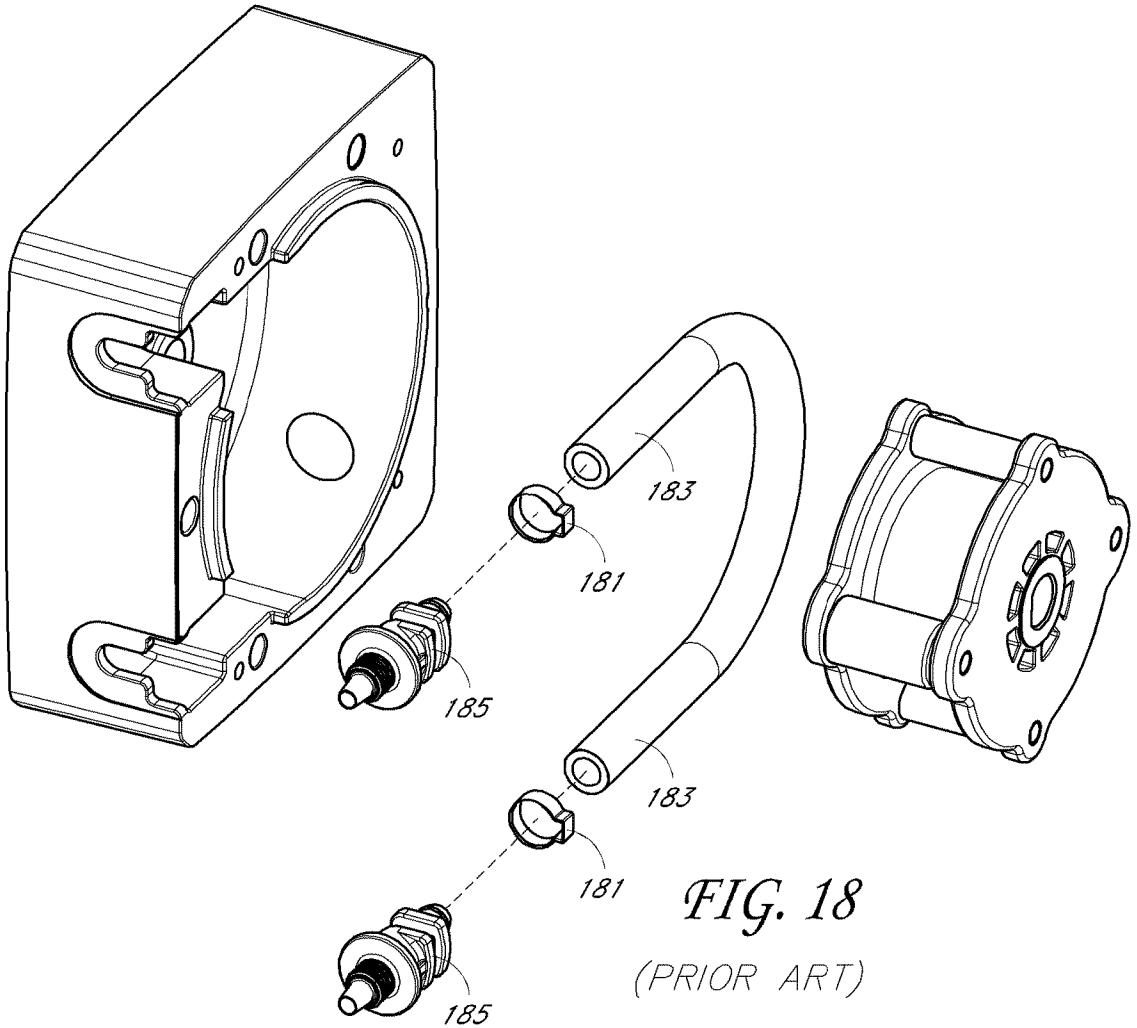
FIG. 18 (PRIOR ART)
FIG. 18 illustrates a prior art peristaltic pump and tubing assembly.
Figure 19:
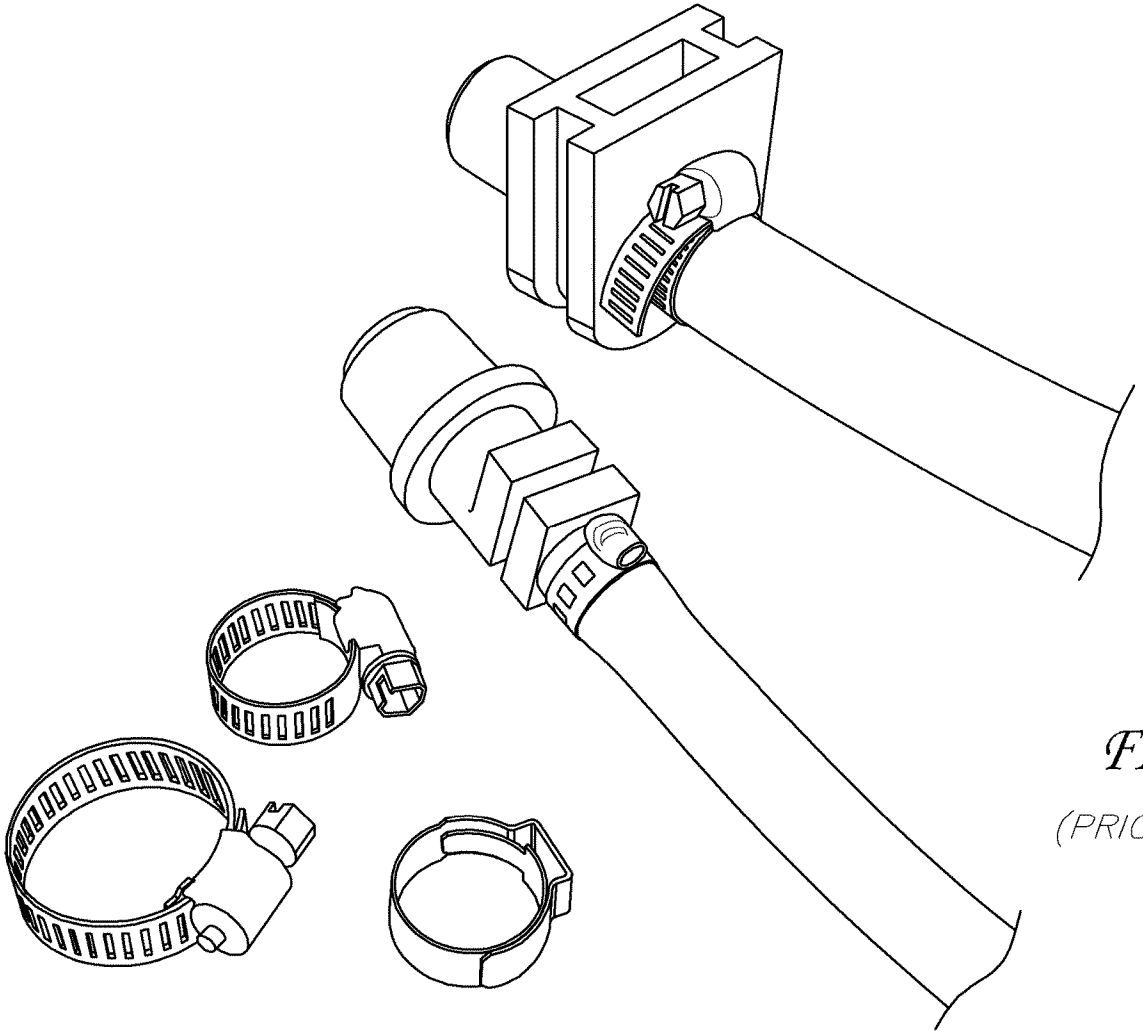
FIG. 19 (PRIOR ART)
FIG. 19 illustrates a prior art tubing, clamp, and adapter assembly.

A prior art peristaltic pump and tubing assembly that uses clamps to secure the tubing to the adapter is shown in FIGS. 18 and 19. As shown, a metal tube clamp 181 is used to secure the tubing 183 to an adapter 185 which is then secured in the pump head housing. This type of tubing assembly is well known and does not generally require high tolerances between the hose barb and clamp-type adapter since the metal hose clamp 181 is adjustable, as shown most clearly in FIG. 19.

However, tubing assemblies configured with metal tube clamps have several disadvantages. Specifically, removal of the metal tube clamp removes a source of metal from the assembly. When assembled within a peristaltic pump, the tubing assembly is desirably leak-tight. However, should any part of the tubing assembly rupture or leak or chemical fumes enter the peristaltic pump housing, any metal pieces, such as the tube clamp, may corrode. Furthermore, tubing assemblies having tube clamps are bulky and the clamps take up space within the peristaltic pump housing. These space considerations are particularly important for multi-tube or multi-lumen tubing assemblies. Since each tube will require a separate tube clamp to secure the tubing to the hose barb, a multi-lumen assembly will include several bulky tube clamps taking up space within the peristaltic pump housing. A clamp-less assembly reduces the space occupied by the tubing and adapter assembly, particularly for a multiple tube assembly. In some embodiments, a clamp-less assembly reduces the space between the tubes of a peristaltic pump tubing assembly by at least 20%, at least 25%, at least 30%, at least 40%, at least 50% or at least 60%.

Furthermore, a large inventory of tubing assembly adapters is often stored to connect the tubing within the peristaltic pump to inlet and outlet tubes to meet customer requirements. As will be discussed in greater detail below, one embodiment illustrates an adapter system having interchangeable components that can be used to fit a variety of tubing profiles, such as single or dual tubes, and customer requirements, such as sanitary fittings, quick-connect fittings, etc. In some such embodiments, a smaller amount of inventory may be needed to satisfy customer requirements, thereby reducing inventory cost and improving inventory control.

Figure 20:
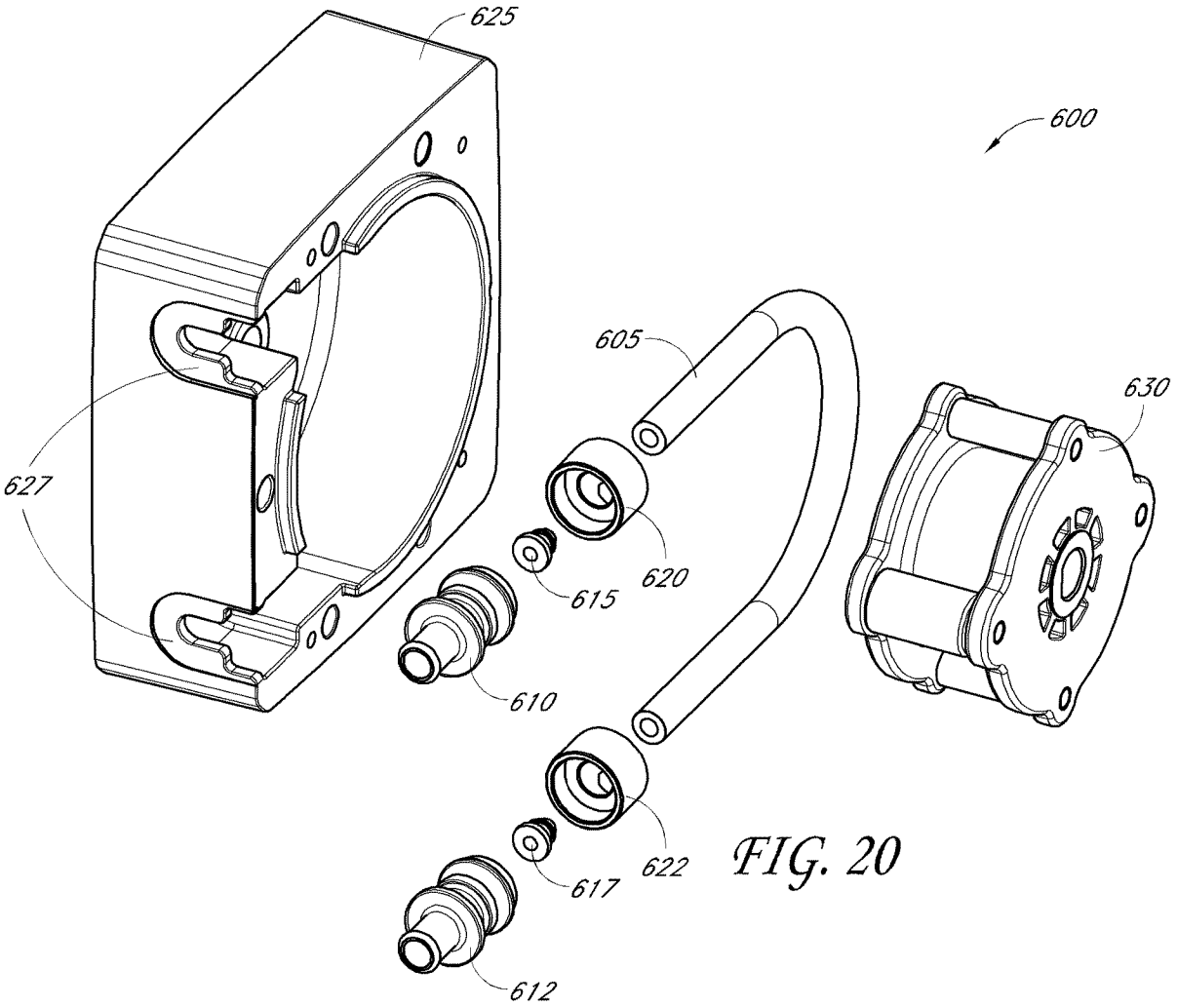
FIG. 20 illustrates an exploded view of a peristaltic pump, tubing, and adapter assembly in accordance with an embodiment.

FIG. 20 illustrates a clamp-less tubing assembly for a peristaltic pump, according to one embodiment. A peristaltic pump assembly 600 is shown with each end of a single tube/elongate body 605 inserted through a tube mount 620, 622 that is then coupled to an external system interface 610, 612. The external system interfaces 610, 612 may be any type of external system interface used to connect the tubing of a peristaltic pump to the fitting of an inlet or outlet tube, such as hose barb, threaded, sanitary, quick-release connection, etc. as will be discussed in greater detail below. In some embodiments, the external system interfaces 610, 612 installed on the tubing of a peristaltic pump may be the same or different external system interfaces, depending on customer requirements.

Figure 26A:
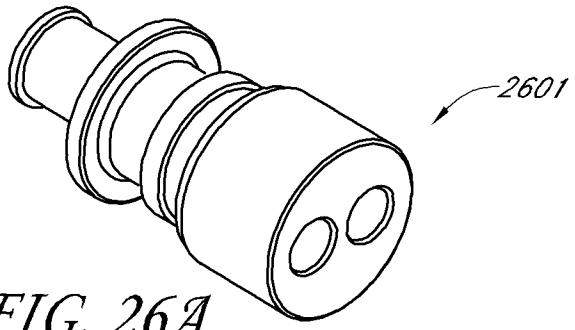
FIG. 26A illustrates an assembled adapter system with a tube mount and an external system interface, according to one embodiment.
Figure 26B:
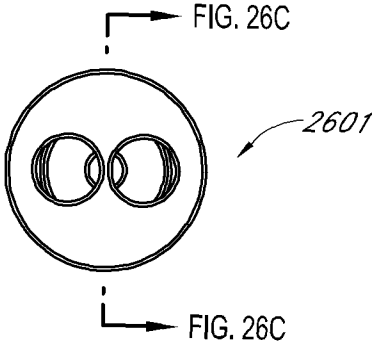
FIG. 26B illustrates a view of the assembled adapter system as seen from the tube mount end, according to one embodiment.

Four examples of an external system interface may be seen in FIGS. 23 and 24A-D. A cross section of one exemplary external system interface is shown in FIG. 26B. Generally, in some embodiments, the external system interface 123, 124, 125, 126 is a hollow member that may be extruded, molded, or otherwise formed with a cylindrical passage extending the length of the external system interface 123, 124, 125, 126. Referring to FIGS. 24A-D, in some embodiments, each external system interface 123, 124, 125, 126 may include a tubing interface portion 1235, 1245, 1255, 1265 configured to connect with a corresponding interface on an inlet or outlet tube of the peristaltic pump, such as a tube supplying fluid to be pumped and a tube delivering the pumped fluid to another application.

In some embodiments, the external system interface 123, 124, 125, 126 may also include a pump interface portion 1231, 1241, 1251, 1261, as shown in FIGS. 24A-D. The pump interface portion 1231, 1241, 1251, 1261 may be a section of the external system interface 123, 124, 125, 126 having a smaller diameter than the surrounding areas, as shown in FIGS. 24A-D. The pump interface portion 1231, 1241, 1251, 1261 may be enclosed on either side by flanges. In some embodiments, the flanges help to secure the external system interface 123, 124, 125, 126 within a notch formed in the pump head housing. Upon installation of the tubing assembly within the pump head housing, the external system interface 123, 124, 125, 126 may be inserted into the notch on the pump head housing defined by flanges 627 and 727 (shown in FIGS. 20 and 21). The flanges 627, 727 sit within the pump interface portion 1231, 1241, 1251, 1261 to hold the external system interface 123, 124, 125, 126 in place.

In some embodiments, the external system interface 123, 124, 125, 126 also includes a mounting interface portion 1237, 1247, 1257, 1267, as shown in FIGS. 24A-D. In some embodiments, the mounting interface portion 1237, 1247, 1257, 1267 is configured to couple with a tube mount.

Figure 23:
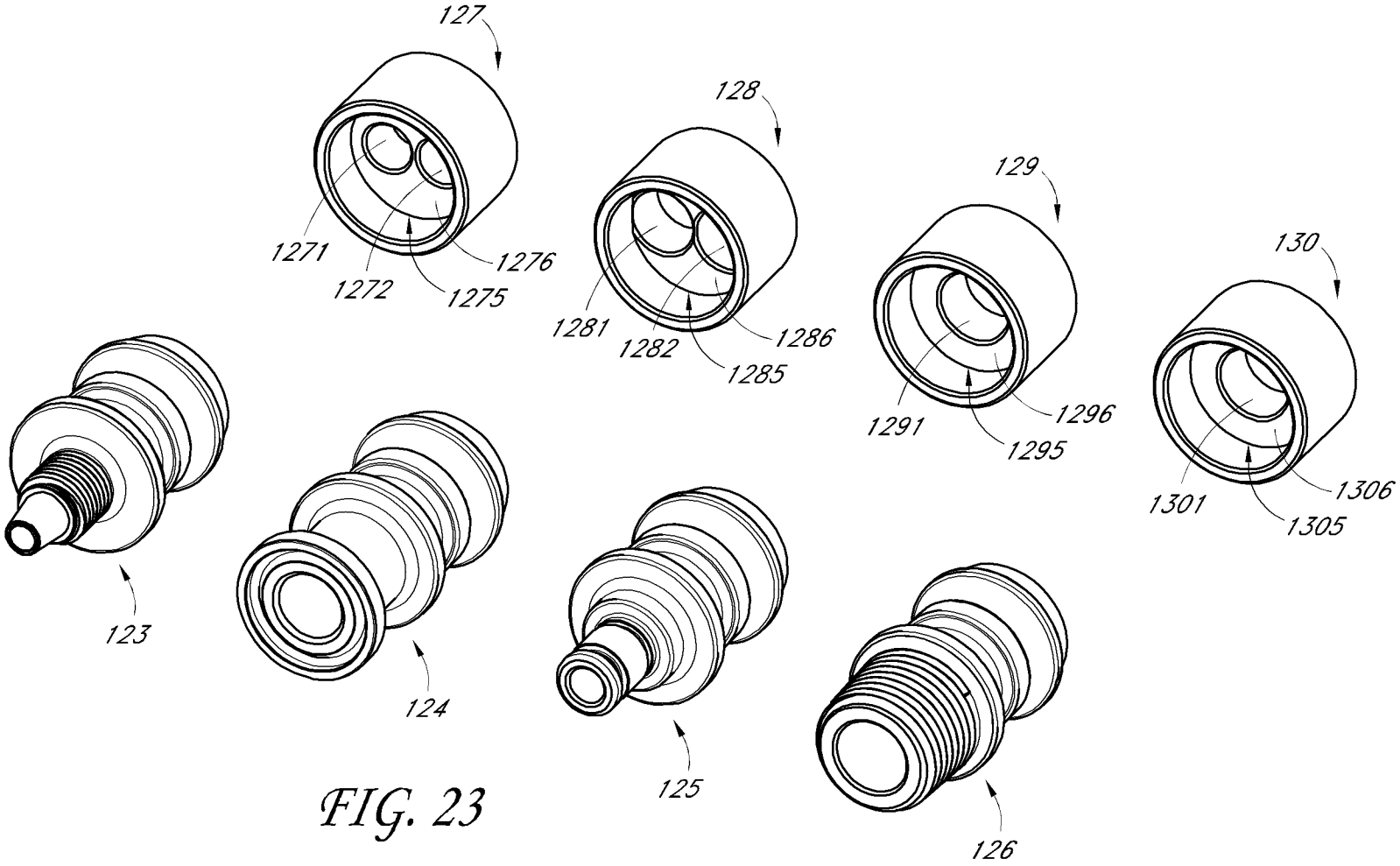
FIG. 23 illustrates various adapter configurations according to embodiments disclosed herein.
Figure 24A:
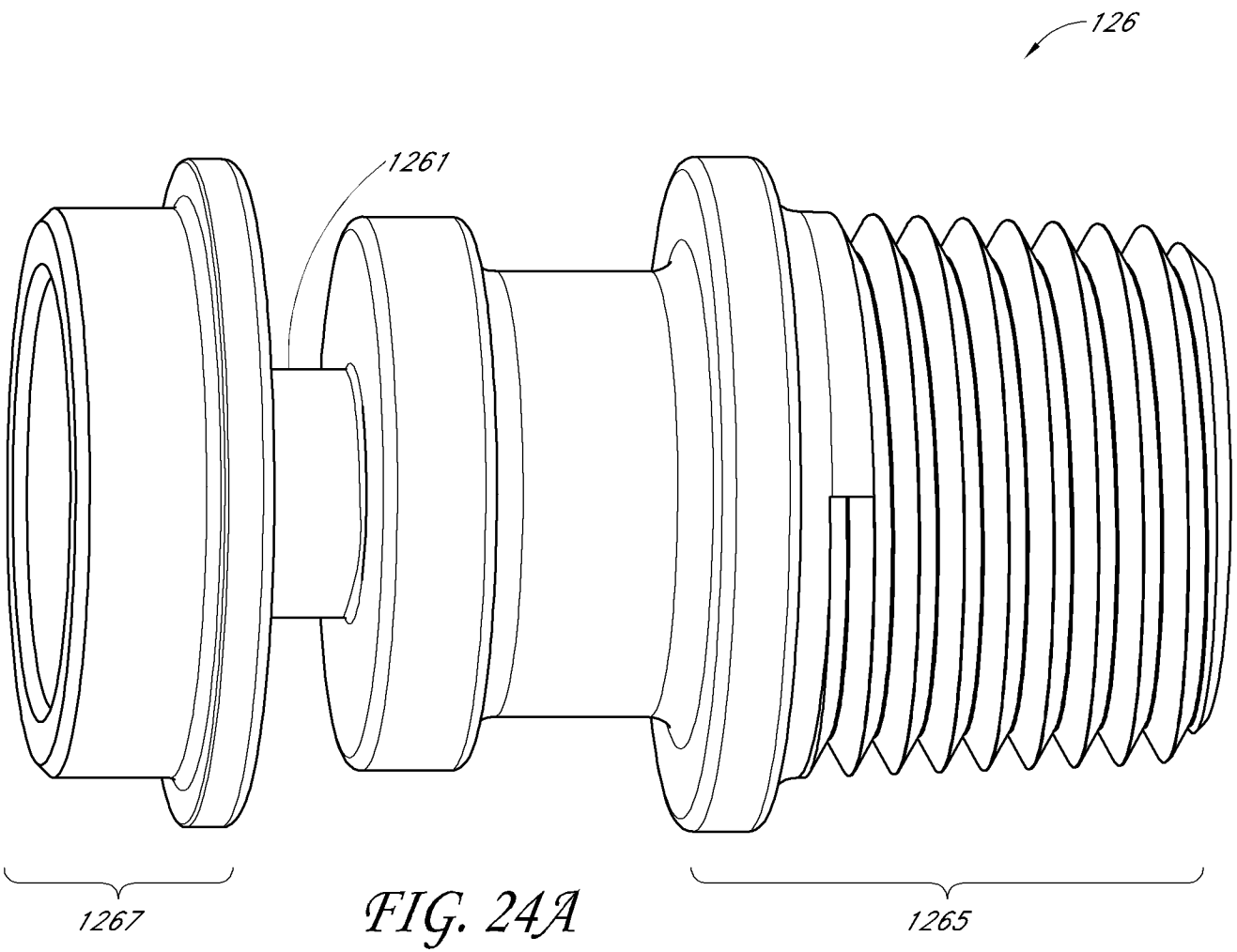
FIGS. 24A-D illustrate various external adapter configurations, according to embodiments disclosed herein.
Figure 24B:
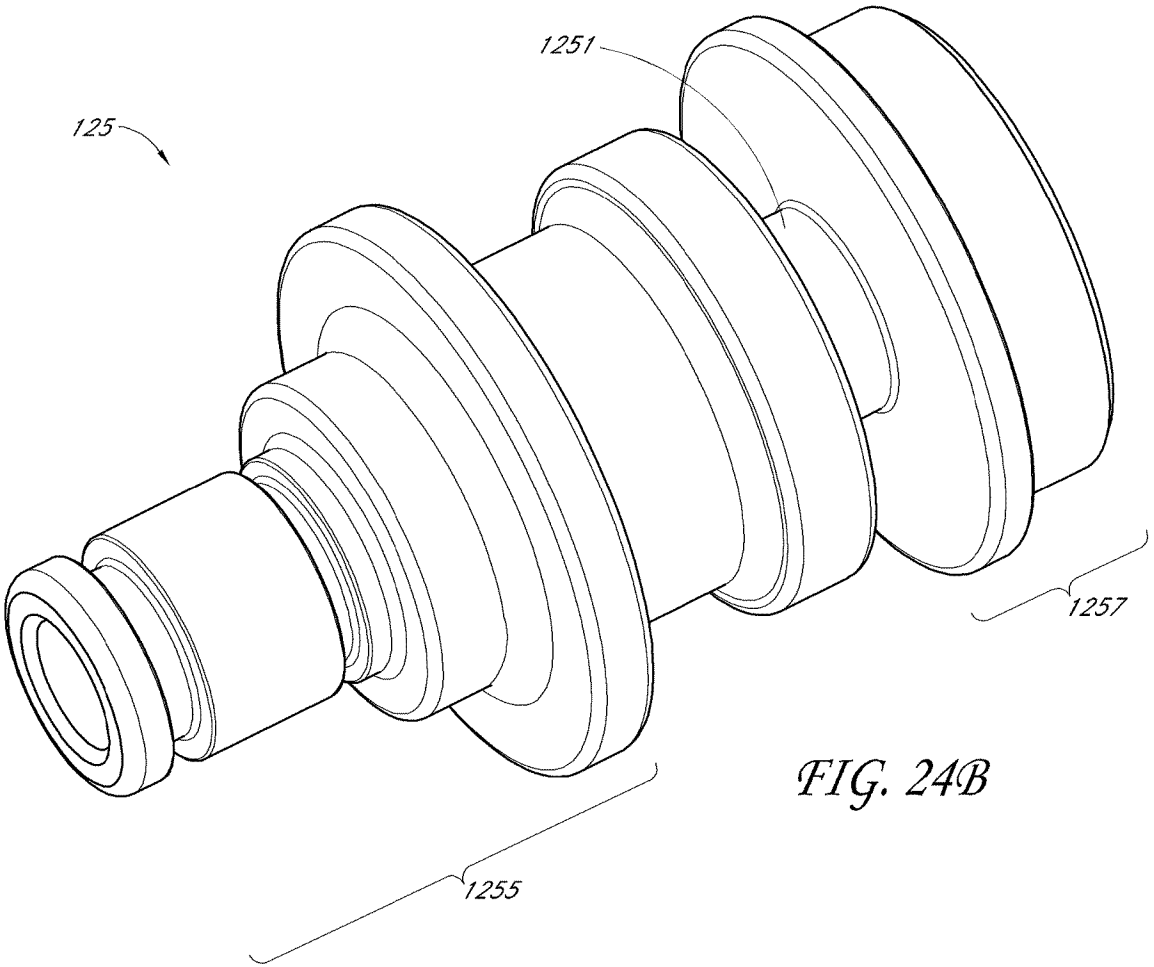
Figure 24C:
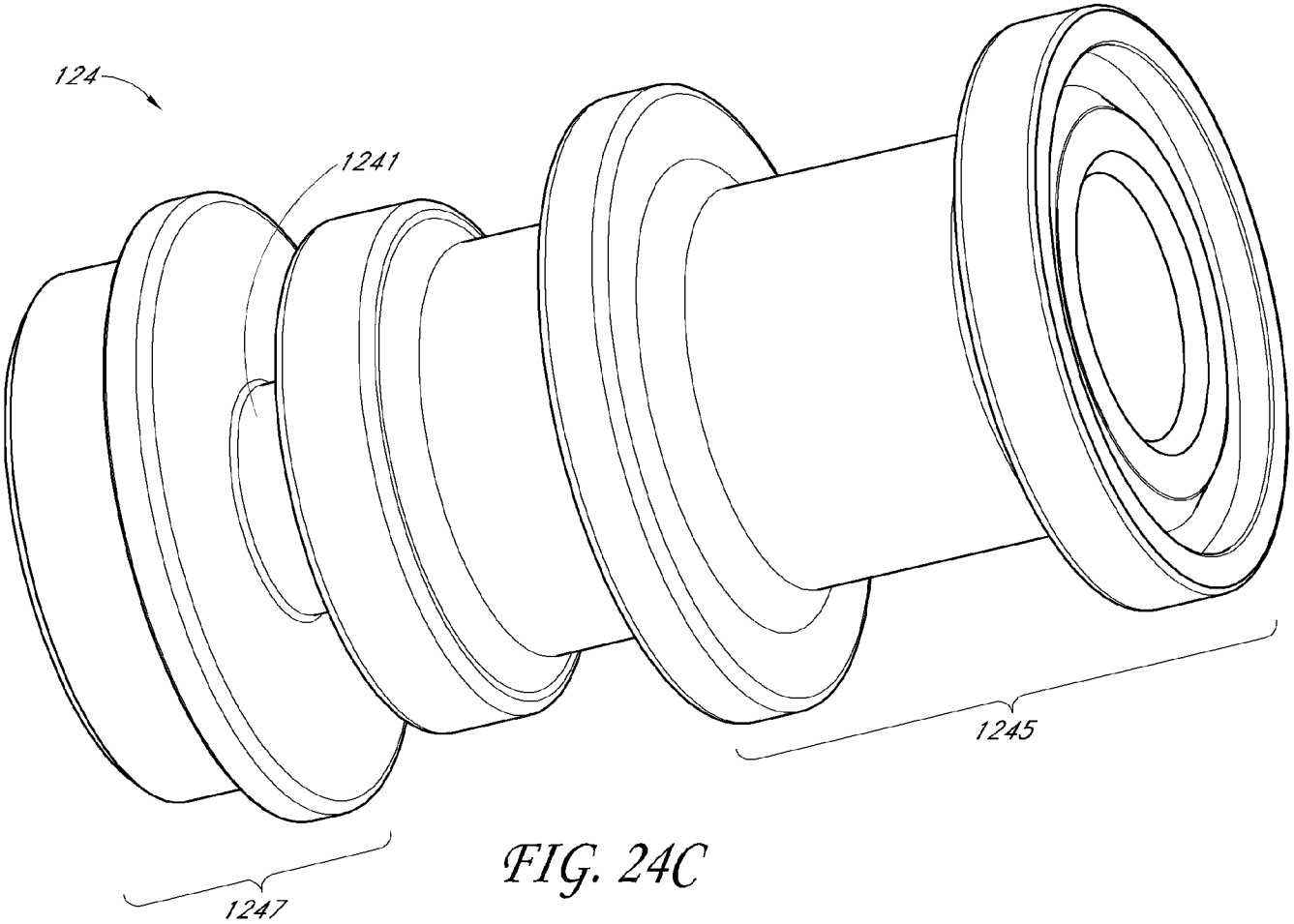
Figure 24D:
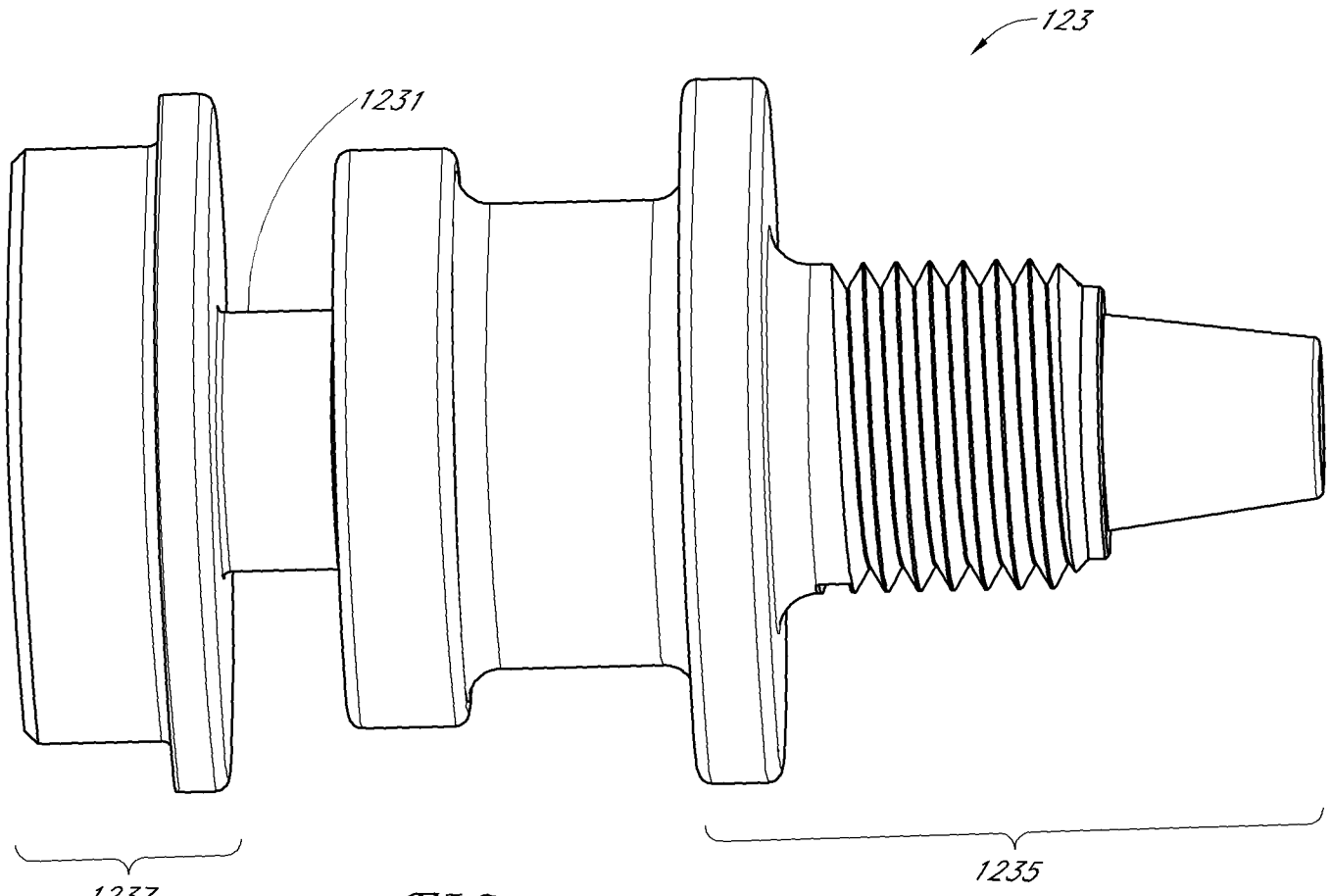
Figure 25A:
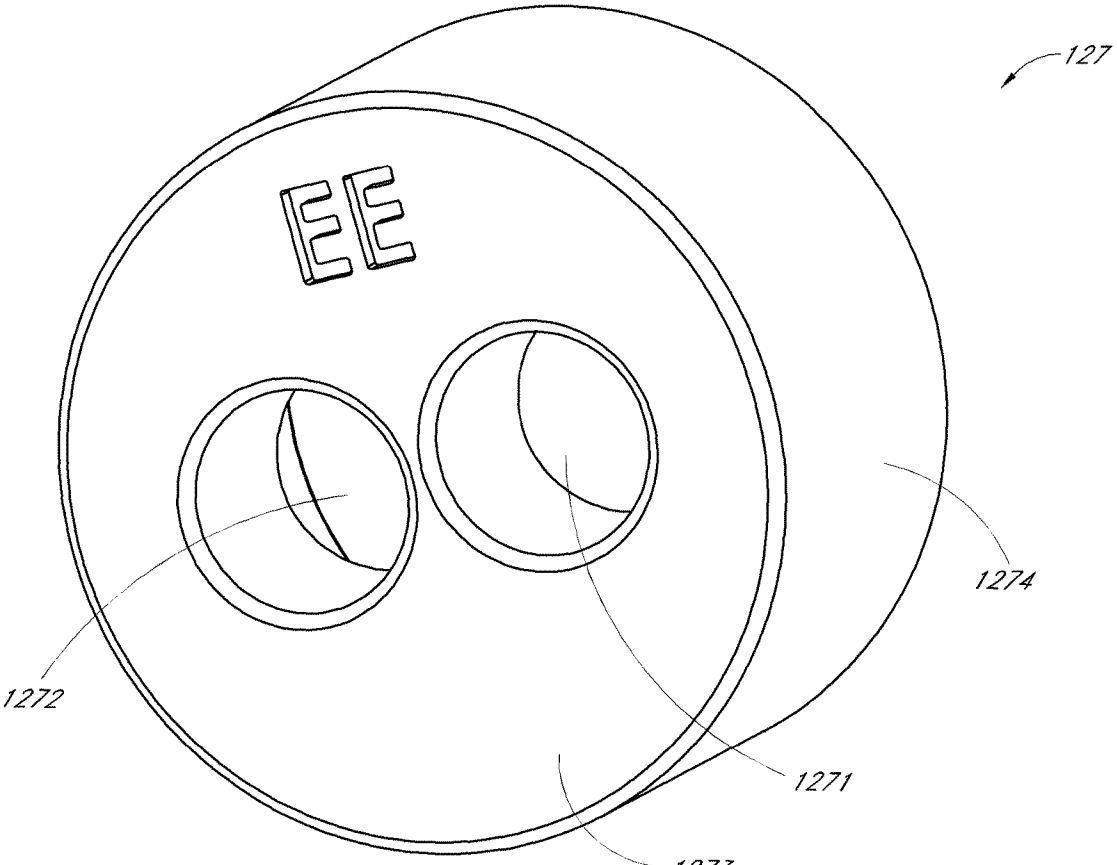
FIGS. 25A-D illustrate various tube mount configurations, according to embodiments disclosed herein.
Figure 25B:
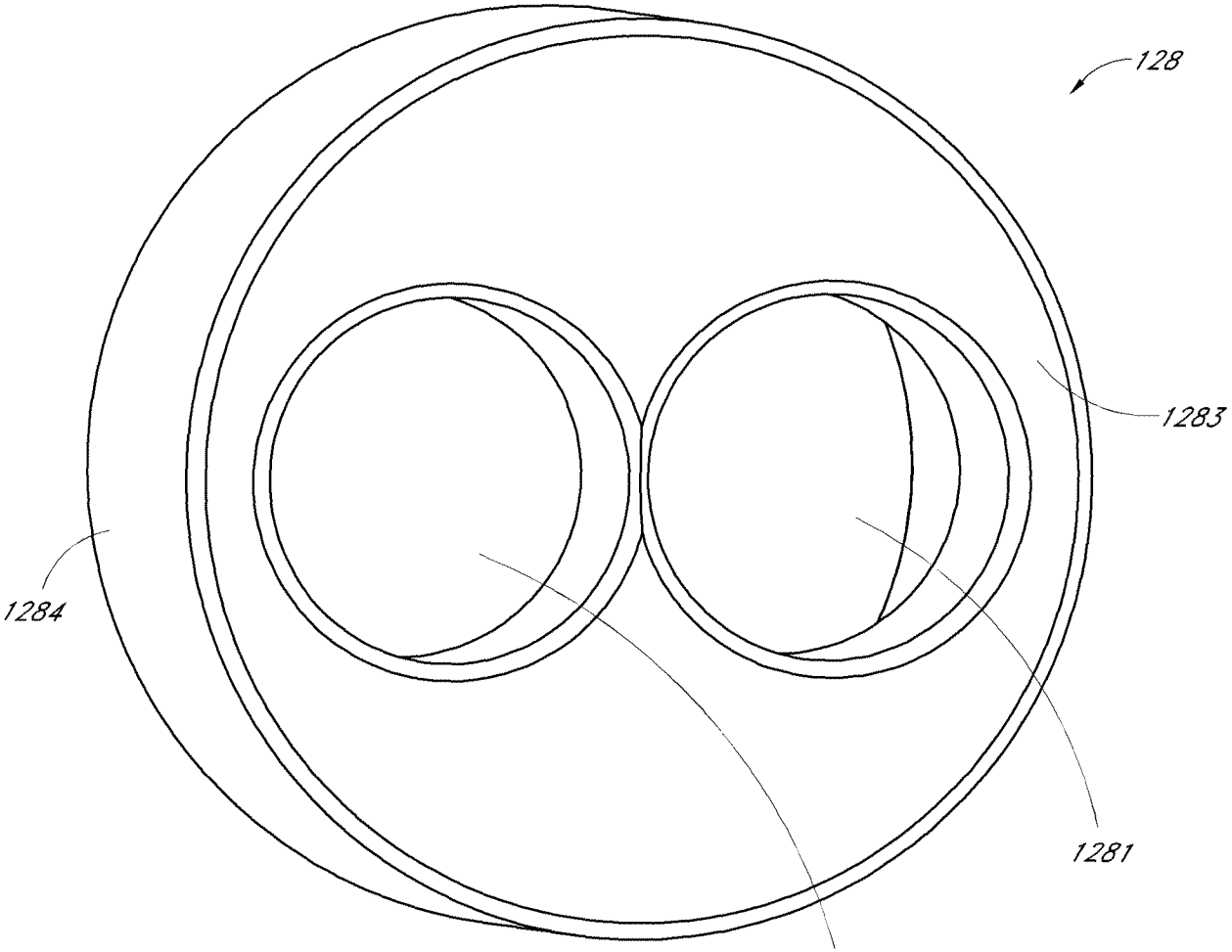

FIGS. 23 and 25A-D illustrate four examples of a tube mount 127, 128, 129, 130. Generally, in some embodiments, the tube mount 127, 128, 129, 130 is a roughly cylindrical member that may be extruded, molded or otherwise formed with one or more openings. The tube mount 127, 128, 129, 130 has a roughly cylindrical side wall 1274, 1284, 1294, 1304. In some embodiments, the tube mount 127, 128, 129, 130 may include a tube interface surface 1273, 1283, 1293, 1303. One or more openings may be disposed in the tube interface surface 1273, 1283, 1293, 1303 to receive one or more tubes. For example, as shown in FIG. 25A, two openings 1271 and 1272 are disposed in the tube interface surface 1273. Dual lumen tubing may be inserted into the openings 1271, 1272, as shown in greater detail in FIG. 21. Similar openings 1281 and 1282 are formed through the surface 1283 of tube mount 128, as shown in FIGS. 23 and 25B.

Figure 25C:
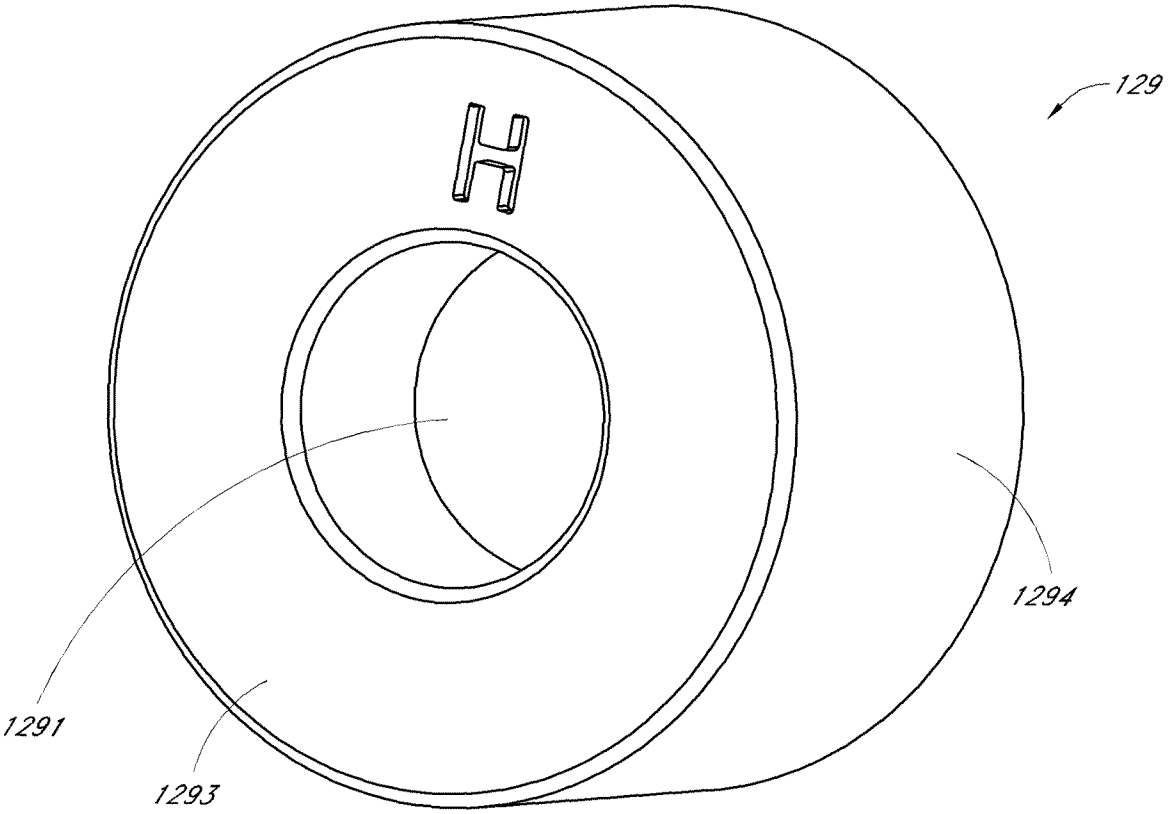
Figure 25D:
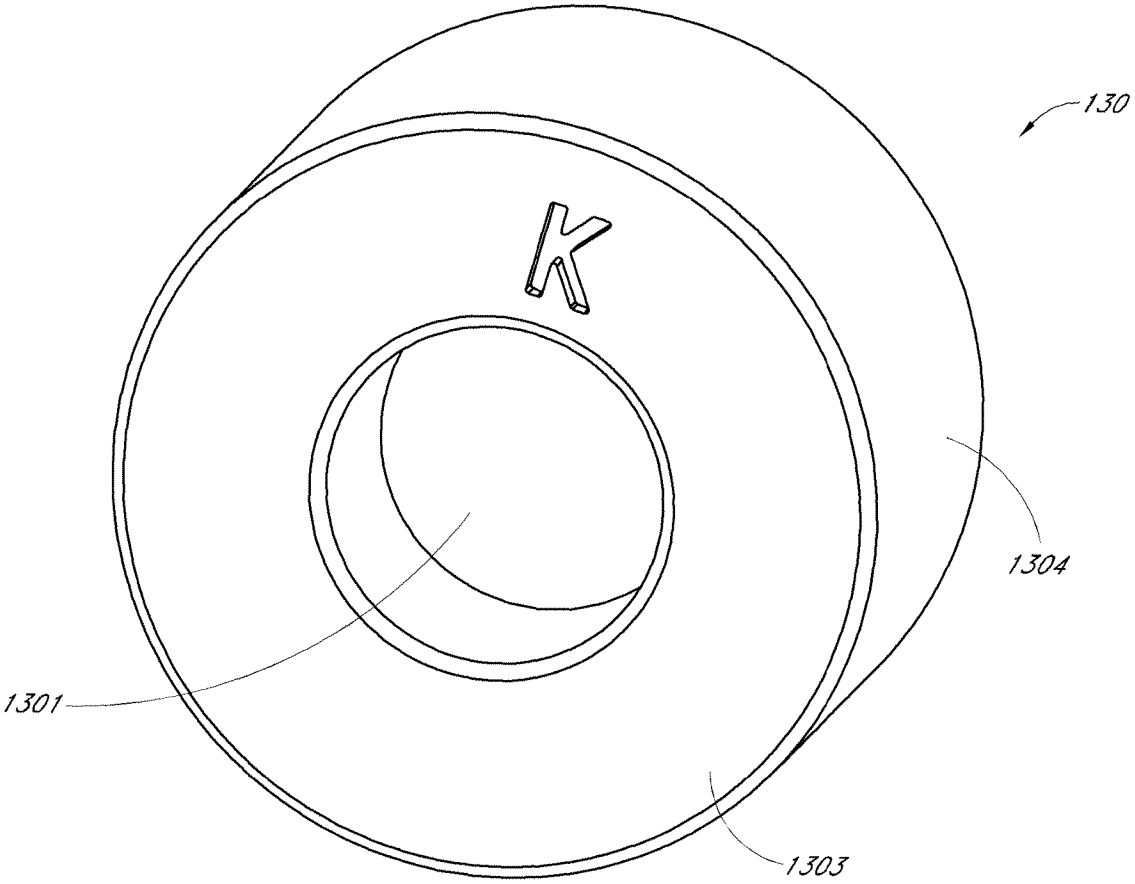

A single tube may be inserted into the single opening 1291 formed in the surface 1293 of tube mount 129, shown in FIGS. 23 and 25C, or into the single opening 1301 formed in the surface 1303 of tube mount 130, shown in FIGS. 23 and 25D. The direction of insertion of the tubing assembly may be seen more clearly in FIG. 20.

Figure 21:
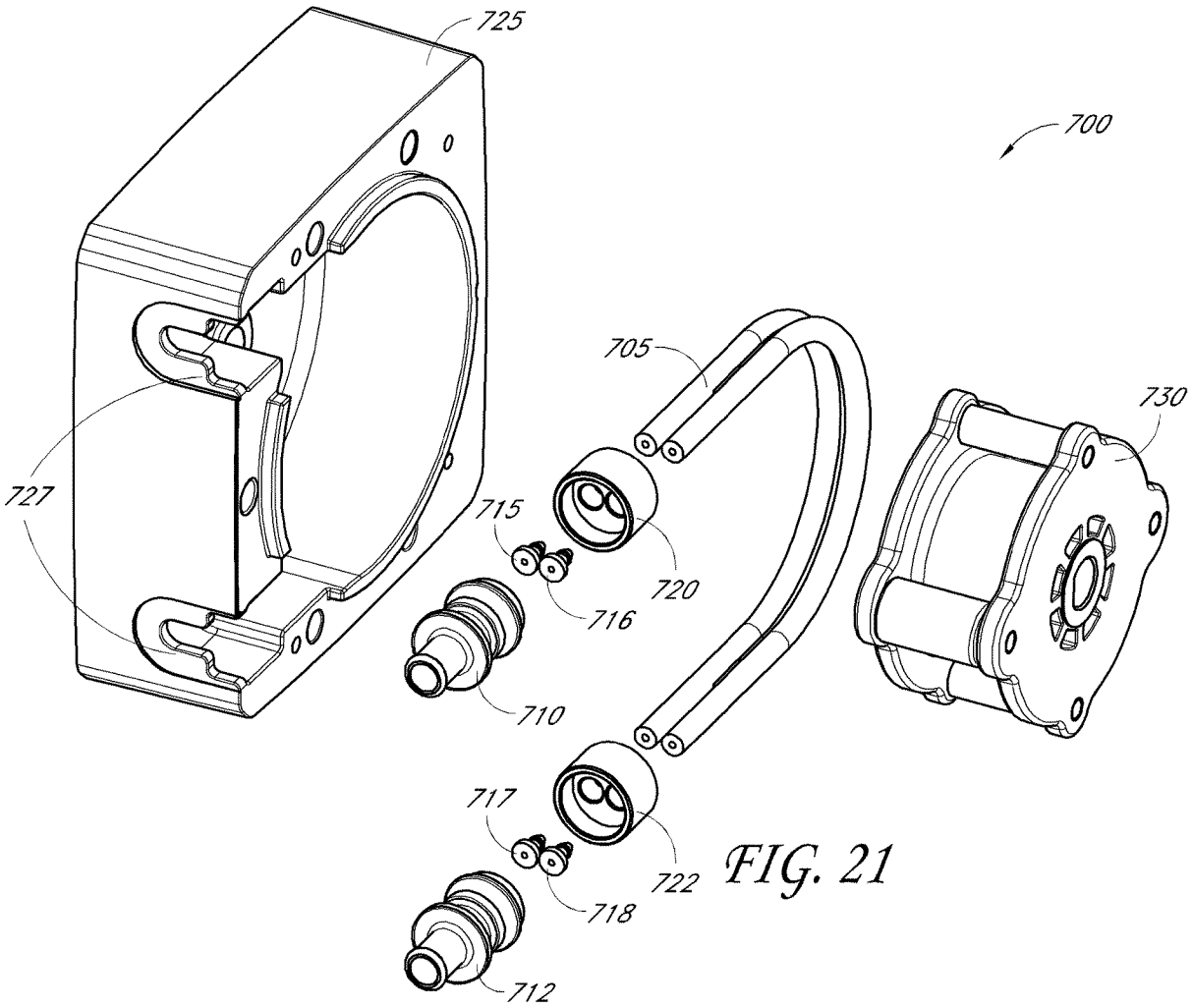
FIG. 21 illustrates an exploded view of a peristaltic pump, tubing, and adapter assembly in accordance with another embodiment.
Figure 26C:
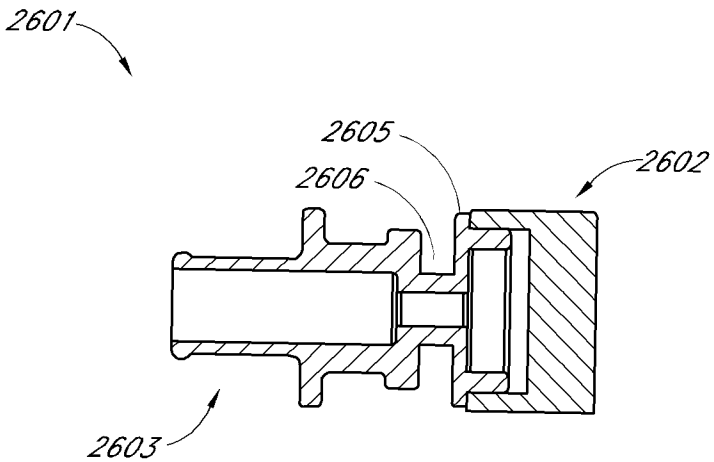
FIG. 26C illustrates a cross section of one exemplary external system interface, according to one embodiment.

As shown in FIGS. 23 and 25A-D, in some embodiments each tube mount 127, 128, 129, 130 may also include an end wall 1276, 1286, 1296, 1306 that is an inner surface of the tube mount opposite the tube interface surface. The end wall 1276, 1286, 1296, 1306 and the side wall 1274, 1284, 1294, 1304 define a recess 1275, 1285, 1295, 1305. As will be discussed in greater detail below, the mounting interface portion 1237, 1247, 1257, 1267 of the external system interface 123, 124, 125, 126 may be coupled to the tube mount 127, 128, 129, 130 by inserting the mounting interface portion 1237, 1247, 1257, 1267 within the recess 1275, 1285, 1295, 1305. FIGS. 26A-C, as well as FIGS. 20 and 21, illustrate this assembly. As will be discussed below, the external system interface may be joined to the tube mount by any of a number of coupling methods, including spin welding, sonic welding, adhesion using glue or other adhesive, threaded connection, or mechanical fastening such as screws, nails, bolts, etc.

FIGS. 26A-B illustrate one embodiment of an assembled adapter system 2601, with a tube mount 2602 and an external system interface 2603. The tube mount 2062 is similar to tube mount 128. The external system interface 2603 is similar to external system interface 125. FIG. 26B illustrates a view of the assembled adapter system 2601 as seen from the tube mount end. FIG. 26C illustrates a cross-sectional view of the assembled adapter system 2601 of FIGS. 26A and B. As illustrated, the assembled adapter system 2601 includes a tube mount 2602. As discussed above, the mounting interface portion of the external system interface 2603 is inserted within the recess of the tube mount 2602 such that the tube mount 2602 abuts a flange 2605 of the external system interface 2603. When the fully assembled adapter system 2601 is inserted within the pump head housing, the flange of the pump head housing, such as flanges 627 and 727 shown in FIGS. 20 and 21, fits within the mounting interface portion 2606 to secure the assembled adapter system within the pump head housing.

In some embodiments, the following process is used to connect the tube mounts and the external system interfaces to the tube 605, as shown in FIG. 20. The first and second ends of the tube may be inserted into the tube mount 620, 622 that may be configured to receive the specific type of tube 605 used within the peristaltic pump assembly 600 such that a tight fit is achieved between each end of the tube 605 and the respective tube mount 620, 622. After insertion of each end of the tube 605 into the respective tube mount 620, 622, a pump tubing gripper/lock 615, 617 is pressed into each end of the tube 605. Each end of the tube 605 is then preferably simultaneously pressed and pushed within the orifice of the corresponding external system interface 610, 612 to create a snug, water-tight seal between the tube 605 and the external system interface 610, 612. The tube mounts 620, 622 may be joined to the external system interfaces 610, 612, respectively, by any of a number of connecting methods, including spin welding, sonic welding, adhesion using glue or other adhesive, threaded connection via O-ring, or mechanical fastening using one or more screws or other mechanical fasteners. Once the adapter system is fully assembled with the tube 605, the tubing assembly may be installed within the pump head or housing 625 configured with peristaltic pump roller 630. However, the tubing assembly described above may be used with any number of peristaltic pump assemblies, such as but not limited to single roller or multiple roller assemblies.

A single tube assembly is shown in FIG. 20. However, in other embodiments, multiple tubes may be used with a clamp-less tubing assembly for a peristaltic pump. FIG. 21 illustrates a dual tube assembly for a peristaltic pump, according to one embodiment. The peristaltic pump assembly 700 is shown with each end of a dual tube/elongate body 705 coupled to an tube mount 720, 722 that may be configured to receive the specific type of tube 705 used within the peristaltic pump assembly 700 such that a tight fit between the tube 705 and the tube mount 720, 722 is achieved. After insertion of each end of the dual tube/elongate body 705 into the tube mount 720, 722, a pump tubing gripper/lock 715, 716, 717, 718 is pressed into each tubing opening at each end of the tube 705. Each end of the tube 705 is then preferably simultaneously pressed and pushed within the orifice of the corresponding external system interface 710, 712 to create a snug, water-tight seal between the tube 705 and the external system interface 710, 712. The tube mounts 720, 722 may be joined to the external system interfaces 710, 712, respectively, by a number of connecting methods, including spin welding, sonic welding, glue or other adhesion, threaded connection via O-ring, or mechanical fastening using one or more screws or other mechanical fasteners. Once the adapter system is fully assembled with the tube 705, the tubing assembly may be installed within the pump head or housing 725 configured with peristaltic pump roller 730. However, the tubing assembly described above may be used with any number of peristaltic pump assemblies, such as but not limited to single roller or multiple roller assemblies.

In addition to the single and dual tubes or lumens discussed above, other single or multiple lumen tubing profiles may be used in other tubing assembly embodiments. For example, in some embodiments, a dual tubing or lumen profile such as those shown in FIGS. 7-14, as well as those shown in FIGS. 22A-C, may be used with the peristaltic pump assembly discussed above. In each embodiment, the tube mount may be configured to receive a tubing profile, such as a single lumen or multiple lumen tubing assembly. In some embodiments, the lumens of a multiple lumen tubing assembly may be separated lengthwise along an attachment portion connecting the multiple lumens along their length, as was described above with respect to FIGS. 7-14 and FIG. 22C, in order to facilitate connection with the tube mounts discussed above.

The tubing assemblies discussed above may be manufactured with various combinations of tube mounts and external system interfaces, depending on the tubing profile (for example, single or multiple lumen tubing) and/or customer requirements. Four different external system interfaces 123, 124, 125, 126 and four different tube mounts 127, 128, 129, 130 are shown in FIGS. 23, 24A-D, and 25A-D. Each external system interface 123, 124, 125, 126 may be paired with each tube mount 127, 128, 129, 130 to provide at least 4! (four factorial) manufactured tubing assembly configurations, depending on the tubing diameter and profile as well as customer requirements. The adapters illustrated in FIG. 23 are examples only and are not meant to illustrate the full range of adapter configurations possible for a tubing assembly. The external system interfaces best illustrated in FIGS. 23 and 24A-D are configured to engage with flanges that form notches on a peripheral edge of the pump housing. FIGS. 20 and 21 illustrate the flanges 627 and 727. Each of the external system interfaces has an engagement region that in some embodiments may be an external groove formed in the body of the external system interface having approximately the same width as the flanges of the pump head. Engagement regions 1231, 1241, 1251, and 1261 are shown in FIGS. 24A-D for the external system interfaces 123, 124, 125, and 126. The external system interfaces may be inserted within the notches formed in the pump head housing such that the flanges 627 or 727 engage with the engagement regions of the external system interfaces to form a secure fit. Once installed, the end of the external system interface connected to the tubing assembly of the peristaltic pump is located within the pump housing while the opposite end of the external system interface is located outside the pump head housing.

In one embodiment, a method of manufacturing tubing assemblies such as those shown in FIGS. 20 and 21 may include the following steps. First, a single or multiple lumen tubing tube mount is selected that corresponds with the tubing profile to be used in the tubing assembly. For example, if a single lumen tube is selected, a tube mount configured to receive a single lumen tube is selected, such as tube mounts 129 or 130, shown in FIG. 23. If multiple lumen tubing is selected, a corresponding multiple lumen tube mount configured to receive multiple lumen tubing may be selected, such as tube mounts 127 or 128 as shown in FIG. 23. If a multiple lumen tubing assembly is selected, such as those shown in FIGS. 8, 9, 12, 13, and 22A, the lumens of the tubing may be separated apart lengthwise at each end by tearing or cutting the attachment portion connecting the multiple lumens so that a single lumen is inserted into each of the openings 1271, 1272, 1281, and 1282 shown in FIG. 23.

After the selection of a tubing assembly and the appropriate tube mount, the lumen or lumens of the tubing assembly are pushed through the orifices or openings of the tube mount, as shown in FIGS. 20 and 21. As shown in FIGS. 23 and 25A-D, the tube mount 127, 128, 129, 130 may have a front surface 1273, 1283, 1293, 1303 having a single opening or orifice or multiple orifices or openings for receiving tubing. The rear or opposite side of the tube mount 127, 128, 129, 130, as shown in FIG. 23, may have a recess 1275, 1285, 1295, 1305. The lumen or lumens 605, 705 of the tubing assembly are inserted into the orifices or openings 1271, 1272, 1281, 1282, 1291, 1301 on the front surface of the tube mount 127, 128, 129, 130 such that the inserted ends of the tubing 605, 705 extend out the opposite side of the tube mount 127, 128, 129, 130 into the recess 1275, 1285, 1295, 1305. After insertion of the ends of the tubing 605, 705 through the tube mount 127, 128, 129, 130, a pump tubing gripper/lock insert 615, 617, 715, 716, 717, 718 is pressed into the end of each lumen 605, 705 of the tubing assembly, as shown in FIGS. 20 and 21 for single and dual tube assemblies. Different pump tubing gripper/lock inserts 615, 617, 715, 716, 717, 718 may be used, depending on the tubing profile.

Next, the tube ends are simultaneously pressed and pushed into place within the desired external system interface 123, 124, 125, 126 to create a snug, water-tight seal. Finally, the external system interface 123, 124, 125, 126 and the tube mount 127, 128, 129, 130 are connected by any of a number of connecting methods, including spin welding, sonic welding, glue or other adhesion, threaded connection via O-ring, or the pieces may screwed together using one or more screws or other mechanical fasteners. In some embodiments, the external system interface 123, 124, 125, 126 may be interchanged with an alternate external system interface 123, 124, 125, 126 after manufacture of the tubing assemblies, such as when the external system interface 123, 124, 125, 126 is attached to the tube mount 127, 128, 129, 130 by threaded connection or mechanical fasteners. In some embodiments, the same external system interface 123, 124, 125, 126 may be used on both the first and second ends of the tubing assembly. In other embodiments, different external system interfaces 123, 124, 125, 126 may be used on the first and second ends of the tubing assembly.

Figure 27B:
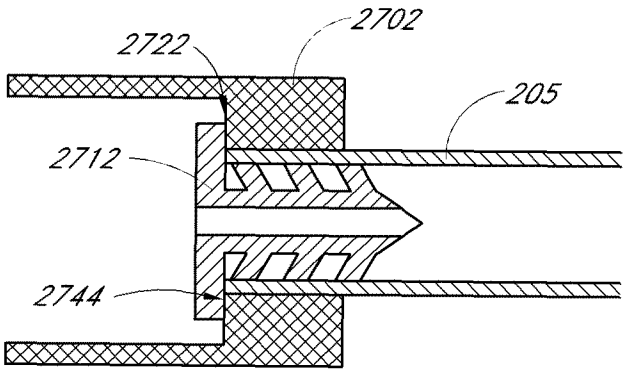
FIG. 27B illustrates a cross section of a tube mount, pump tubing gripper/lock, and tube assembly, according to another embodiment.
Figure 27C:
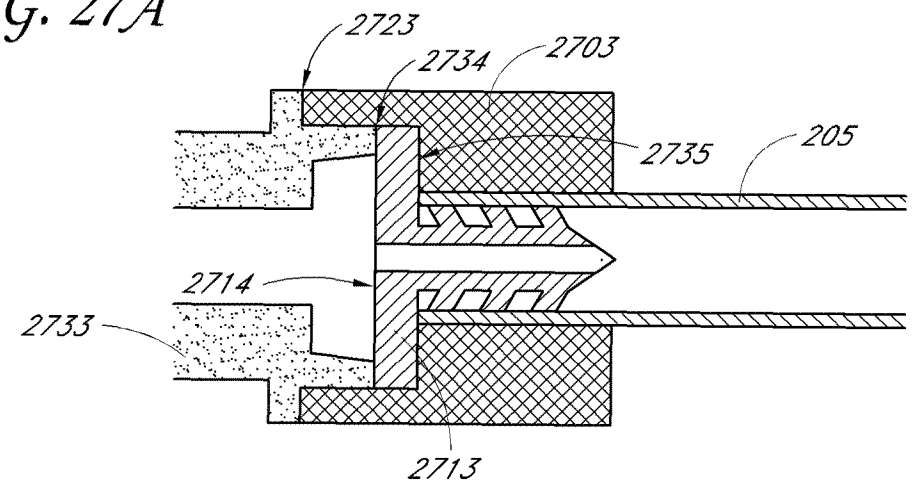
FIG. 27C illustrates a cross section of a tube mount, pump tubing gripper/lock, tube, and external system interface assembly, according to a third embodiment.
Figure 27A:
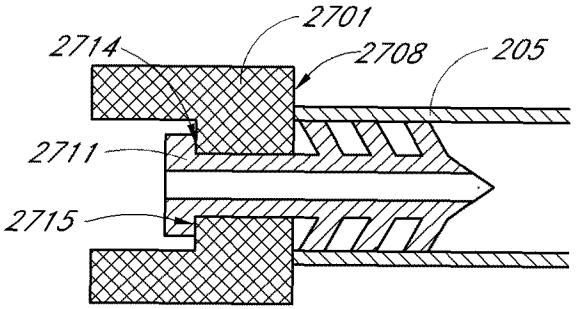
FIG. 27A illustrates a cross section of a tube mount, pump tubing gripper/lock, and tube assembly, according to one embodiment.

FIGS. 27A-C illustrate three embodiments of the tube mount, pump tubing gripper/lock and tube assembly. In FIG. 27A, the end of a tube 205 abuts against the tube interface surface 2708 of the tube mount 2701. A pump tubing gripper/lock 2711 is inserted through the opening in the tube mount 2701 and into the end of the tube 205. The pump tubing gripper/lock 2711 has a flange having a surface 2714 that abuts against the end wall 2715 of the tube mount 2701 to secure the tube 205 to the tube mount 2701.

A second embodiment of the assembly is shown in FIG. 27B. In this embodiment, the tube 205 is pressed through an opening in the tube mount 2702. A pump tubing gripper/lock 2712 is then inserted into the end of the tube 205. The pump tubing gripper/lock 2712 has a flange having a flange surface 2744 that abuts the end wall 2722 of the tube mount 2702. In some embodiments, friction between the tube 205 and the tube mount 2702 may hold the tube 205 in place without longitudinal movement. In other embodiments, adhesive or other suitable material to join the pump tubing gripper/lock 2712 to the tube mount 2702, that is, between the end wall 2722 and the flange surface 2744, may be required to prevent the tube 205 from longitudinal movement within the tube mount 2702.

FIG. 27C illustrates a third embodiment of the assembly. In this embodiment, a tube 205 is pressed through an opening in the tube mount 2703. A pump tubing gripper/lock 2713 is then inserted into the end of the tube 205. In this embodiment, the pump tubing gripper/lock 2713 need not be adhered to the end wall 2735. Instead, the top flange surface 2714 of the pump tubing gripper/lock 2713 abuts against an end surface 2734 of the external system interface 2733. Similar to the embodiment shown in FIG. 26C, the tube mount 2703 abuts against the flange 2723 of the external system interface 2733.

In each shown in FIGS. 27A-C, an external system interface similar to the external system interfaces 123, 124, 125, 126 shown in FIG. 23 may be coupled to the tube mount by any of the methods discussed in greater detail above.

Embodiments of the tubing assemblies disclosed herein can be fabricated using a variety of materials, such as polymer materials, rubber, polyurethane, neoprene, tygothane, and others. Further, the tubing assemblies can be fabricated as a composite of multiple materials, or monolithically or uniformly using a single material. Embodiments of the external system interfaces and tube mounts disclosed herein may be manufactured from plastics.

Although embodiments of these inventions have been disclosed in the context of certain examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions.

What is claimed is:

1. A tubing and adapter assembly for a peristaltic pump, the tubing and adapter assembly comprising:

an elongate body defining a longitudinal axis, a first end, and a second end, the elongate body having at least one lumen extending along the longitudinal axis, the at least one lumen being surrounded by a tube wall, the at least one lumen extending from the first end to the second end such that the first end is in fluid communication with the second end of the elongate body;

a first tube mount having a first axis, a first cylindrical side wall surrounding the first axis, a first tube interface surface at an end of the first cylindrical side wall, the first tube interface surface transverse to the first cylindrical side wall and extending radially inward from the first cylindrical side wall with respect to the first axis, the first tube interface surface having at least one opening, and a first end wall opposite the first tube interface surface, the first end wall and the first cylindrical side wall defining a first recess;

a second tube mount having a second axis, a second cylindrical side wall surrounding the second axis, a second tube interface surface at an end of the second cylindrical side wall transverse to the second cylindrical side wall and extending radially inward from the second cylindrical side wall with respect to the second axis, the second tube interface surface having at least one opening, and a second end wall opposite the second tube interface surface, the second end wall and the second cylindrical side wall defining a second recess;

a first external system interface having an annular surface defining a first flow passage, a first tubing interface portion, a first pump interface portion, and a first mounting interface portion, the first external system interface connectable to the first tube mount;

a second external system interface having an annular surface defining a second flow passage, a second tubing interface portion, a second pump interface portion, and a second mounting interface portion, the second external system interface connectable to the second tube mount;

wherein the first end of the elongate body is configured to be coupled with and inserted through the at least one opening of the first tube mount and the second end of the elongate body is configured to be coupled with and inserted through the at least one opening of the second tube mount; wherein a rotor of the peristaltic pump can operate against the elongate body for pumping fluid through the tubing and adapter assembly.

2. The tubing and adapter assembly of claim 1, wherein the first external system interface is one of a hose barb adapter, threaded adapter, sanitary adapter, and quick-release adapter.

3. The tubing and adapter assembly of claim 1, wherein the second external system interface is one of a hose barb adapter, threaded adapter, sanitary adapter, and quick-release adapter.

4. The tubing and adapter assembly of claim 1, wherein the first external system interface is the same type of interface as the second external system interface.

5. The tubing and adapter assembly of claim 1, wherein the first external system interface is not the same type of interface as the second external system interface.

6. The tubing and adapter assembly of claim 1, wherein the first tube mount is coupled to the first external system interface by one of spin welding, sonic welding, glue, threaded connection, and one or more mechanical fasteners.

7. The tubing and adapter assembly of claim 1, wherein the second tube mount is coupled to the second external system interface by one of spin welding, sonic welding, glue, threaded connection, and one or more mechanical fasteners.

8. The tubing and adapter assembly of claim 1, wherein the elongate body comprises three lumens.

9. The tubing and adapter assembly of claim 1, wherein the elongate body comprises two lumens.

10. The tubing and adapter assembly of claim 1, wherein the elongate body comprising a pair of lumens each having a respective tube wall, the tube walls of the elongate body being fused together.

11. The tubing and adapter assembly of claim 1, wherein the elongate body comprising three lumens each having a respective tube wall, the tube walls of the elongate body being fused together.

12. The tubing and adapter assembly of claim 1, wherein the elongate body comprising a plurality of lumens each having a respective tube wall, the tube walls of the elongate body being interconnected longitudinally by a coupling.

13. The tubing and adapter assembly of claim 12, wherein the coupling extends between the elongate body comprising a pair of lumens each having a respective tube wall, the tube walls of the elongate body being fused together.

14. The tubing and adapter assembly of claim 13, wherein the plurality of lumens may be separated by tearing the coupling.

* * * * *